US010512958B2

(12) United States Patent
Serizawa et al.

(10) Patent No.: US 10,512,958 B2
(45) Date of Patent: Dec. 24, 2019

(54) WATER REMOVING APPARATUS AND WATER REMOVING METHOD FOR STEEL SHEET COOLING WATER IN HOT ROLLING PROCESS

(71) Applicant: NIPPON STEEL & SUMITOMO METAL CORPORATION, Tokyo (JP)

(72) Inventors: Yoshihiro Serizawa, Tokyo (JP); Shinsuke Kai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 357 days.

(21) Appl. No.: 15/321,071

(22) PCT Filed: Jun. 17, 2015

(86) PCT No.: PCT/JP2015/067453
§ 371 (c)(1),
(2) Date: Dec. 21, 2016

(87) PCT Pub. No.: WO2016/006402
PCT Pub. Date: Jan. 14, 2016

(65) Prior Publication Data

US 2017/0136512 A1 May 18, 2017

(30) Foreign Application Priority Data

Jul. 10, 2014 (JP) ..... 2014-142126

(51) Int. Cl.
*B21B 45/02* (2006.01)

(52) U.S. Cl.
CPC ..... *B21B 45/0281* (2013.01); *B21B 45/0218* (2013.01)

(58) Field of Classification Search
CPC ..... B21B 45/0281
See application file for complete search history.

(56) References Cited

U.S. PATENT DOCUMENTS

2015/0101386 A1 4/2015 Nikaido et al.

FOREIGN PATENT DOCUMENTS

| | | | | |
|---|---|---|---|---|
| CN | 103480661 A | | 1/2014 | |
| CN | 103495609 A | | 1/2014 | |
| CN | 103747888 A | | 4/2014 | |
| JP | 59-13573 B2 | | 3/1984 | |
| JP | 60149731 A | * | 8/1985 | ..... B21B 45/0233 |

(Continued)

OTHER PUBLICATIONS

Canadian Office Action for Canadian Application No. 2,953,309, dated Nov. 3, 2017.

(Continued)

*Primary Examiner* — Shelley M Self
*Assistant Examiner* — Jared O Brown
(74) *Attorney, Agent, or Firm* — Birch, Stewart, Kolasch & Birch, LLP

(57) ABSTRACT

A plurality of water removing nozzles of a water removing apparatus comprise one or more of a single far water removing nozzle and a far water removing nozzle group. The single far water removing nozzle forms a far end water removal single area that does not include one end but includes the other end in the width direction of a steel sheet conveyance plane. The far water removing nozzle group forms the far end water removal single area and one or more inner water removal single areas that do not include either end in the width direction of the steel sheet conveyance plane, in such a manner that the far end water removal single area and the one or more inner water removal single areas are aligned in order from the one end side to the other end side while overlapping with each other in the width direction of the steel sheet conveyance plane and aligned in order from the upstream side to the downstream side without overlapping in the conveyance direction.

8 Claims, 20 Drawing Sheets

(56) References Cited

FOREIGN PATENT DOCUMENTS

| | | | | | |
|---|---|---|---|---|---|
| JP | 3-230809 | A | | 10/1991 | |
| JP | 03230809 | A | * | 10/1991 | ..... B21B 45/0218 |
| JP | 07009023 | A | * | 1/1995 | ..... B21B 45/0218 |
| JP | 10-34226 | A | | 2/1998 | |
| JP | 10034226 | A | * | 2/1998 | ..... B21B 45/02 |
| JP | 11-197734 | A | | 7/1999 | |
| JP | 11-290933 | A | | 10/1999 | |
| JP | 2001-353515 | A | | 12/2001 | |
| JP | 2009-241113 | A | | 10/2009 | |
| JP | 2009241113 | A | * | 10/2009 | ..... B21B 45/02 |
| JP | 2012-51013 | A | | 3/2012 | |
| WO | WO 2013/183694 | A1 | | 12/2013 | |

OTHER PUBLICATIONS

Korean Office Action and English translation for Korean Application No. 10-2016-7036685, dated Nov. 20, 2017.

International Search Report for PCT/JP2015/067453 dated Aug. 25, 2015.

Office Action for TW 104120544 dated May 26, 2016.

Written Opinion of the International Searching Authority for PCT/JP2015/067453 (PCT/ISA/237) dated Aug. 25, 2015.

Japanese Office Action dated Aug. 29, 2017 for corresponding Japanese Application No. 2016-532841, with partial English translation.

Chinese Office Action and Search Report, dated Jan. 29, 2018, for corresponding Chinese Application No. 201580037441.1, with an English translation.

Extended European Search Report, dated Jan. 31, 2018, for corresponding European Application No. 15818158.6.

European Office Action, dated Apr. 16, 2019, for corresponding European Application No. 15818158.6.

Indonesian Office Action for Indonesian Application No. P00201700674, dated Aug. 2, 2019, with partial English translation.

* cited by examiner

16
E
30
31
10a
10
40
41
42
43a
51
41a
43
52
43b
50
10b
θc
X
Y

WATER REMOVING APPARATUS AND WATER REMOVING METHOD FOR STEEL SHEET COOLING WATER IN HOT ROLLING PROCESS

TECHNICAL FIELD

The present invention relates to a water removing apparatus and a water removing method that remove cooling water that has been jetted to the hot rolling steel sheet when cooling a hot rolling steel sheet before and after rough rolling or before and after finish rolling of a hot rolling process, and relates particularly to a water removing apparatus and a water removing method that remove a large amount of cooling water.

BACKGROUND ART

A hot rolling steel sheet after finish rolling of a hot rolling process is cooled to a prescribed temperature by a cooling apparatus provided above and below the run-out table while being conveyed by a run-out table from the finish rolling mill to a winding apparatus, and is then wound around the winding apparatus. In the hot rolling of the hot rolling steel sheet, the condition of the cooling after finish rolling is an important factor in determining the mechanical properties, formability, weldability, etc. of the hot rolling steel sheet, and it is important to uniformly cool the hot rolling steel sheet to a prescribed temperature.

In the cooling process after finish rolling, the hot rolling steel sheet is usually cooled using, for example, water (hereinafter, referred to as cooling water) as a cooling medium. Specifically, the hot rolling steel sheet is cooled using cooling water in a prescribed cooling area of the hot rolling steel sheet. In order to uniformly cool the hot rolling steel sheet to a prescribed temperature as described above, it is necessary to prevent a situation in which surplus cooling water flows out to an area other than the cooling area and consequently the hot rolling steel sheet is cooled in the area other than the cooling area.

Hence, the removal of cooling water on the hot rolling steel sheet is performed. Thus far, various methods have been proposed as the water removing method for the cooling water.

Patent Literature 1 discloses a method in which water removing nozzles are placed on both sides in the width direction of a steel sheet, water-removing water is jetted by each water removing nozzle to the upper surface of the steel sheet over the entire width, and thereby the removal of the cooling water is performed.

Patent Literature 2 discloses a method in which a plurality of water removing nozzles are aligned in the conveyance direction of a steel sheet on one side in the width direction of the steel sheet, water-removing water is jetted by each water removing nozzle to the upper surface of the steel sheet over the entire width, and thereby the removal of the cooling water is performed.

Patent Literature 3 discloses a method in which a plurality of water removing nozzles are aligned in the width direction of a steel sheet above the steel sheet, water-removing water is jetted by the plurality of water removing nozzles so as to oppose the flow on the steel sheet, and thereby the removal of the cooling water is performed.

CITATION LIST

Patent Literature

| | |
|---|---|
| Patent Literature 1: | JP S59-13573B |
| Patent Literature 2: | JP H11-197734A |
| Patent Literature 3: | JP 2012-51013A |

SUMMARY OF INVENTION

Technical Problem

However, in the case where the method described in Patent Literature 1 is used, the water removing nozzle jets water-removing water to the upper surface of the steel sheet over the entire width; hence, the collision strength of water-removing water varies in the width direction of the steel sheet, and water removal efficiency is poor. That is, on the side far from the side where the water removing nozzle is installed (the opposite side to the side where the water removing nozzle is installed), the collision strength of water-removing water is weak, and water leakage occurs. Consequently, a large amount of water-removing water is needed. In particular, from the recent demand to improve the material quality of steel sheets, the steel sheet is required to be cooled with cooling water with a large water flow density of, for example, 1.0 $m^3/m^2/min$ or more; but when removing such a large amount of cooling water, a still larger amount of water-removing water is needed.

Further, in the case where the method described in Patent Literature 2 is used, the water removing nozzle jets water-removing water from one side of the steel sheet to the upper surface of the steel sheet over the entire width; hence, the collision strength of water-removing water varies in the width direction of the steel sheet, and water removal efficiency is poor. That is, on the side far from the side where the water removing nozzle is installed (the opposite side to the side where the water removing nozzle is installed), the collision strength of water-removing water is weak, and water leakage occurs. Consequently, a large amount of water-removing water is needed.

Further, in the case where the method described in Patent Literature 3 is used, a space for installing the water removing nozzle is needed above the steel sheet. Hence, in the space for installing the water removing nozzle, for example, a cooling water nozzle that jets cooling water cannot be installed, and the cooling of the steel sheet cannot be performed; consequently, the cooling performance on the steel sheet is reduced. In addition, it is difficult to newly install a water removing nozzle.

The present invention has been made in view of such circumstances, and an object of the present invention is to remove the cooling water appropriately with good efficiency when cooling a hot rolling steel sheet before and after rough rolling or before and after finish rolling of a hot rolling process with cooling water.

Solution to Problem

To achieve the above described object, the present invention is characterized by a water removing apparatus for steel sheet cooling water in a hot rolling process that removes cooling water jetted to the hot rolling steel sheet when cooling a hot rolling steel sheet before and after rough rolling or before and after finish rolling of a hot rolling process, the water removing apparatus comprising: a plurality of water removing nozzles that are aligned in a conveyance direction of the hot rolling steel sheet on one side or both sides in a width direction of a steel sheet conveyance plane and jet water-removing water to the steel sheet conveyance plane. A water removal single area that is an area of collision of water-removing water jetted from one of the water removing nozzles in the steel sheet conveyance plane has a prescribed width less than a width of the steel sheet conveyance plane, and the plurality of water removing nozzles are arranged so as to cover the entire area in the width direction of the steel sheet conveyance plane with the plurality of water removal single areas. One or more water removing nozzles that are placed on a lateral side of one end in the width direction of the steel sheet conveyance plane among the plurality of water removing nozzles comprise one or more of a single far water removing nozzle and a far water removing nozzle group. The single far water removing nozzle forms a far end water removal single area that does not include the one end but includes another end in the width direction of the steel sheet conveyance plane. The far water removing nozzle group comprises one or more inner water removing nozzles and the far water removing nozzle, and one or more inner water removal single areas, which the one or more inner water removing nozzles form and which do not include either end in the width direction of the steel sheet conveyance plane, and the far end water removal single area which the far water removing nozzle forms, are formed. The one or more inner water removal single areas and the far water removing nozzle are aligned in order from the one end side to the other end side while overlapping with each other in the width direction of the steel sheet conveyance plane and aligned in order from an upstream side to a downstream side without overlapping in the conveyance direction. The steel sheet conveyance plane in the present invention is the pass line of the hot rolling steel sheet.

According to the present invention, by the far end water removal single area from the far water removing nozzle on the one end side in the width direction of the steel sheet conveyance plane, the cooling water is pushed out to the other end side. As a result, the cooling water on the hot rolling steel sheet is discharged from the lateral side appropriately.

Further, in the far water removing nozzle group, the jet flow of water-removing water from the inner water removing nozzle on the upstream side mainly has the function of intercepting cooling water, and the jet flow of water-removing water from the far water removing nozzle on the downstream side of the inner water removing nozzle mainly has the function of pushing out cooling water. That is, the cooling water is intercepted by the jet flow from the inner water removing nozzle, in other words, by a wall of water-removing water. At this time, the speed of the cooling water in the inner water removal single area becomes slower, and accordingly the height of the cooling water becomes higher. Further, the cooling water is pushed out to the other end side by the jet flow from the far water removing nozzle. At this time, the speed of the cooling water in the far end water removal single area becomes faster than the speed of the cooling water in the inner water removal single area mentioned above, and the height of the cooling water becomes lower. Therefore, even when the height of the jet flow of water-removing water from the far water removing nozzle is low, the cooling water is discharged from the other end side appropriately.

Here, in the case where, as in the past, the cooling water is removed by one water removing nozzle over the entire width of the hot rolling steel sheet, the water removing nozzle needs to have both of the function of intercepting cooling water and the function of pushing out cooling water described above. To achieve the function of intercepting cooling water, it is necessary to form a wall of water-removing water so as to intercept cooling water with a high height, and a large water flow density is needed. On the other hand, to achieve the function of pushing out cooling water, it is sufficient that a speed in the width direction of the steel sheet conveyance plane be given to cooling water with a low height, and only a small water flow density is needed. If one water removing nozzle achieves both functions, a large amount of water-removing water is needed.

In contrast, in the present invention, the functions of the plurality of water removing nozzles are separated as described above, and thereby the amount of water-removing water jetted from each water removing nozzle can be reduced. Therefore, the water removal efficiency of cooling water can be improved, and energy efficiency can be improved.

Furthermore, the plurality of water removal single areas from the plurality of water removing nozzles cover the entire area in the width direction of the steel sheet conveyance plane. Therefore, the cooling water can be removed appropriately by the water removing apparatus.

Moreover, the plurality of water removing nozzles are placed on the lateral side in the width direction of the steel sheet conveyance plane, and the installation space is small. Therefore, the installation flexibility of the water removing apparatus is high, and the placement of the cooling apparatus is not influenced by the water removing apparatus. Therefore, the cooling performance on the hot rolling steel sheet can be ensured appropriately.

Thus, according to the present invention the cooling water can be removed appropriately with good efficiency when cooling a hot rolling steel sheet before and after rough rolling or before and after finish rolling of a hot rolling process with cooling water.

In the water removing apparatus, one or more of the single far water removing nozzle(s) or one or more of the far water removing nozzle group(s) may be placed on both sides in the width direction of the steel sheet conveyance plane.

In the water removing apparatus, in addition to the single far water removing nozzle or the far water removing nozzle group, a near water removing nozzle may be placed on the lateral side of the one end in the width direction of the steel sheet conveyance plane. The near water removing nozzle may form a near end water removal single area, which is not included in either a far end water removal single area that the single far water removing nozzle forms or a far water removal area group that the far water removing nozzle group forms and which includes the one end in the width direction of the steel sheet conveyance plane on the upstream side in the conveyance direction of the far end water removal single area or the far water removal area group. Water removal may be continuously performed by at least the single far water removing nozzle or the far water removing nozzle group and the near water removing nozzle from the one end to the other end in the width direction of the steel sheet conveyance plane.

In the water removing apparatus, a water removing nozzle, which is placed in the downstream side at a second or a subsequent position from the upstream side in the conveyance direction among the plurality of water removing nozzles, forms the water removal single area in a manner that, in a planar view, a far side of a long axis of the water removal single area is inclined from the width direction toward the downstream side in the conveyance direction.

Another aspect of the present invention is characterized by a water removing method for steel sheet cooling water in a hot rolling process by which cooling water jetted to the hot rolling steel sheet are removed when cooling a hot rolling steel sheet before and after rough rolling or before and after finish rolling of a hot rolling process, the water removing method comprising: removing cooling water by jetting water-removing water to the hot rolling steel sheet with a plurality of water removing nozzles that are aligned in a conveyance direction of the hot rolling steel sheet on one side or both sides in a width direction of the hot rolling steel sheet. A water removal single area that is an area of collision of water-removing water jetted from one of the water removing nozzles on the hot rolling steel sheet has a prescribed width less than a width of the hot rolling steel sheet, and the plurality of water removal single areas formed by the plurality of water removing nozzles cover the entire area in the width direction of the hot rolling steel sheet. One or more water removing nozzles that are placed on a lateral side of one end in the width direction of the hot rolling steel sheet among the plurality of water removing nozzles comprise one or more of a single far water removing nozzle and a far water removing nozzle group. The single far water removing nozzle forms a far end water removal single area that does not include the one end but includes another end in the width direction of the hot rolling steel sheet. The far water removing nozzle group comprises one or more inner water removing nozzles and the far water removing nozzle, and one or more inner water removal single areas, which the one or more inner water removing nozzles form and which do not include either end in the width direction of the hot rolling steel sheet, and the far end water removal single area, which the far water removing nozzle forms, are formed. The one or more inner water removal single areas and the far water removing nozzle are aligned in order from the one end side to the other end side while overlapping with each other in the width direction of the hot rolling steel sheet and at aligned in order from an upstream side to a downstream side without overlapping in the conveyance direction.

In the water removing method, one or more of the single far water removing nozzle(s) or one or more of far water removing nozzle group(s) may be placed on both sides in the width direction of the hot rolling steel sheet.

In the water removing method, in addition to the single far water removing nozzle or the far water removing nozzle group, a near water removing nozzle may be placed on the lateral side of the one end in the width direction of the hot rolling steel sheet. The near water removing nozzle may form a near end water removal single area, which is not included in either a far end water removal single area that the single far water removing nozzle forms or a far water removal area group that the far water removing nozzle group forms and which includes the one end in the width direction of the hot rolling steel sheet on the upstream side in the conveyance direction of the far end water removal single area or the far water removal area group. Water removal may be continuously performed by at least the single far water removing nozzle or the far water removing nozzle group and the near water removing nozzle from the one end to the other end in the width direction of the hot rolling steel sheet.

In the water removing method, a water removing nozzle, which is placed in the downstream side at a second or a subsequent position from the upstream side in the conveyance direction among the plurality of water removing nozzles, may form the water removal single area in a manner that, in a planar view, a far side of a long axis of the water removal single area is inclined from the width direction toward the downstream side in the conveyance direction.

Advantageous Effects of Invention

According to the present invention, the cooling water can be removed appropriately with good efficiency when cooling a hot rolling steel sheet before and after rough rolling or before and after finish rolling of a hot the rolling process with cooling water.

DESCRIPTION OF EMBODIMENTS

1. Hot Rolling Facility

Figure 1:
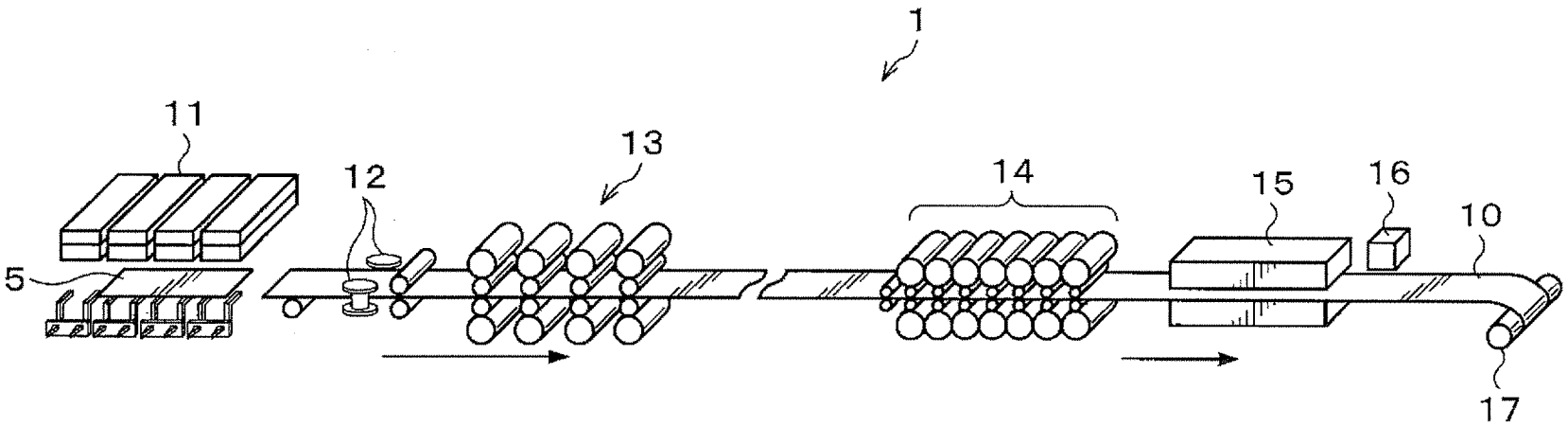
FIG. 1 is an illustration diagram showing an overview of the configuration of a hot rolling facility including a water removing apparatus in an embodiment of the present invention.

Hereinbelow, embodiments of the present invention are described. FIG. 1 is an illustration diagram showing an overview of the configuration of a hot rolling facility 1 comprising a cooling apparatus in an embodiment.

In the hot rolling facility 1, a heated slab 5 is continuously rolled by being vertically sandwiched between rolls and is thereby thinned to the minimum sheet thickness of 1 mm, and a hot rolling steel sheet 10 is wound. The hot rolling facility 1 comprises a heating furnace 11 for heating the slab 5, a width-direction rolling mill 12 that rolls the slab 5 that has been heated in the heating furnace 11 in the width direction, a rough rolling mill 13 that rolls the slab 5 that has been rolled in the width direction while vertically sandwiching the slab 5 to make a rough bar, a finish rolling mill 14 that further performs finish hot rolling continuously on the rough bar to a prescribed thickness, a cooling apparatus 15 that uses cooling water to cool the hot rolling steel sheet 10 which has been subjected to finish hot rolling by the finish rolling mill 14, a water removing apparatus 16 that removes the cooling water jetted from the cooling apparatus 15, and a winding apparatus 17 that winds the hot rolling steel sheet 10 that has been cooled by the cooling apparatus 15 into a coil form. The above is a general configuration, and the configuration is not limited thereto.

In the heating furnace 11, the treatment of heating the slab 5, which is carried in from the outside via an inlet to a prescribed temperature, is performed. When the heating treatment in the heating furnace 11 is finished, the slab 5 is conveyed to the outside of the heating furnace 11, and is then subjected to a rolling process by the rough rolling mill 13.

The conveyed slab 5 is rolled by the rough rolling mill 13 to a sheet thickness of approximately 30 to 60 mm, and is conveyed to the finish rolling mill 14.

In the finish rolling mill 14, the conveyed hot rolling steel sheet 10 is rolled to a sheet thickness of approximately several millimeters. The rolled hot rolling steel sheet 10 is conveyed by conveyor rolls 18, and is transferred to the cooling apparatus 15.

The hot rolling steel sheet 10 is cooled by the cooling apparatus 15, and is wound in a coil form by the winding apparatus 17. The configurations of the cooling apparatus 15 and the water removing apparatus 16 are described below in detail.

2. Cooling Apparatus

Figure 2:
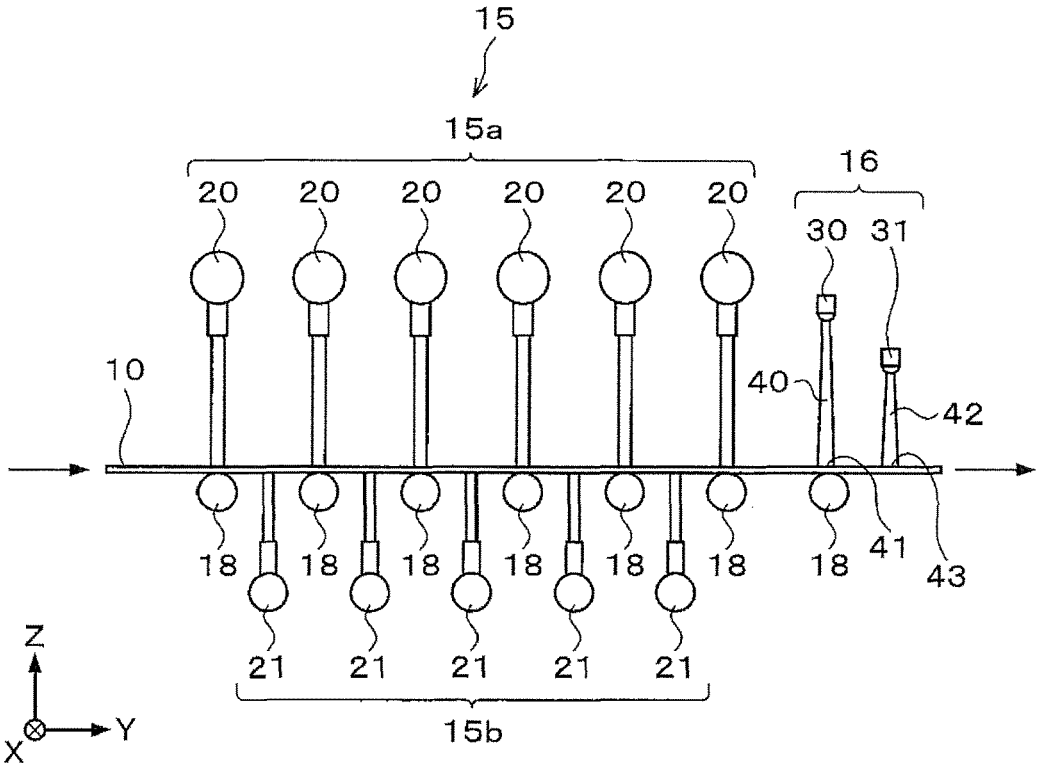
FIG. 2 is a side view showing an overview of the configurations of a cooling apparatus and the water removing apparatus.

Next, the configuration of the cooling apparatus 15 mentioned above is described. The cooling apparatus 15 comprises, as shown in FIG. 2, an upper cooling apparatus 15*a* placed above the hot rolling steel sheet 10 that is conveyed on the conveyor rolls 18 of a run-out table and a lower cooling apparatus 15*b* placed below the hot rolling steel sheet 10.

The upper cooling apparatus 15*a* comprises a plurality of cooling water nozzles 20 that jet cooling water from above the hot rolling steel sheet 10 toward the upper surface of the hot rolling steel sheet 10 vertically downward. As the cooling water nozzle 20, for example, a slit laminar nozzle or a pipe laminar nozzle is used. The plurality of cooling water nozzles 20 are aligned in the conveyance direction of the hot rolling steel sheet 10 (the Y-direction in the drawing). In the embodiment, the cooling water nozzle 20 jets cooling water to the hot rolling steel sheet 10 with a large water flow density of 1.0 to 10 $m^3/m^2/min$, and thereby cools the hot rolling steel sheet 10 to a prescribed temperature. As the cooling water nozzle 20, other nozzles may be used.

The lower cooling apparatus 15*b* comprises a plurality of cooling water nozzles 21 that jet cooling water from below the hot rolling steel sheet 10 toward the lower surface of the hot rolling steel sheet 10 vertically upward. As the cooling water nozzle 21, for example, a pipe laminar nozzle is used. A plurality of cooling water nozzles 21 are aligned in the conveyance direction of the hot rolling steel sheet 10 (the Y-direction in the drawing). In addition, a plurality of cooling water nozzles 21 are aligned in the width direction of the hot rolling steel sheet 10 (the X-direction in the drawing) between a pair of conveyor rolls 18 and 18 adjacent in the conveyance direction of the hot rolling steel sheet 10.

3. Water Removing Apparatus

Figure 3:
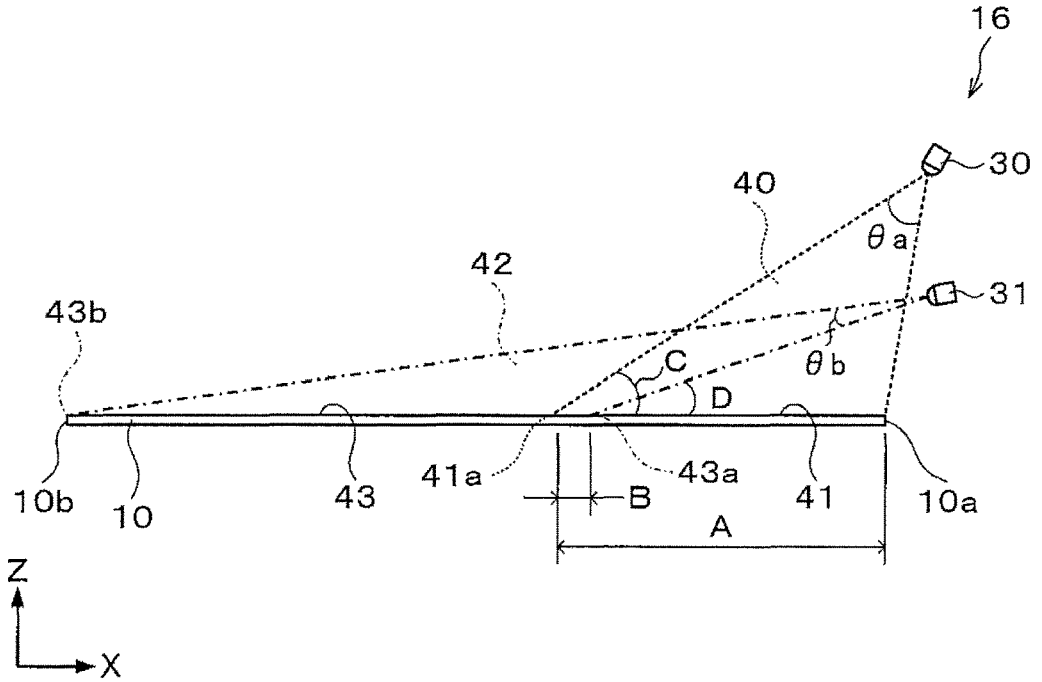
FIG. 3 is a side view showing an overview of the configuration of the water removing apparatus.
Figure 4:
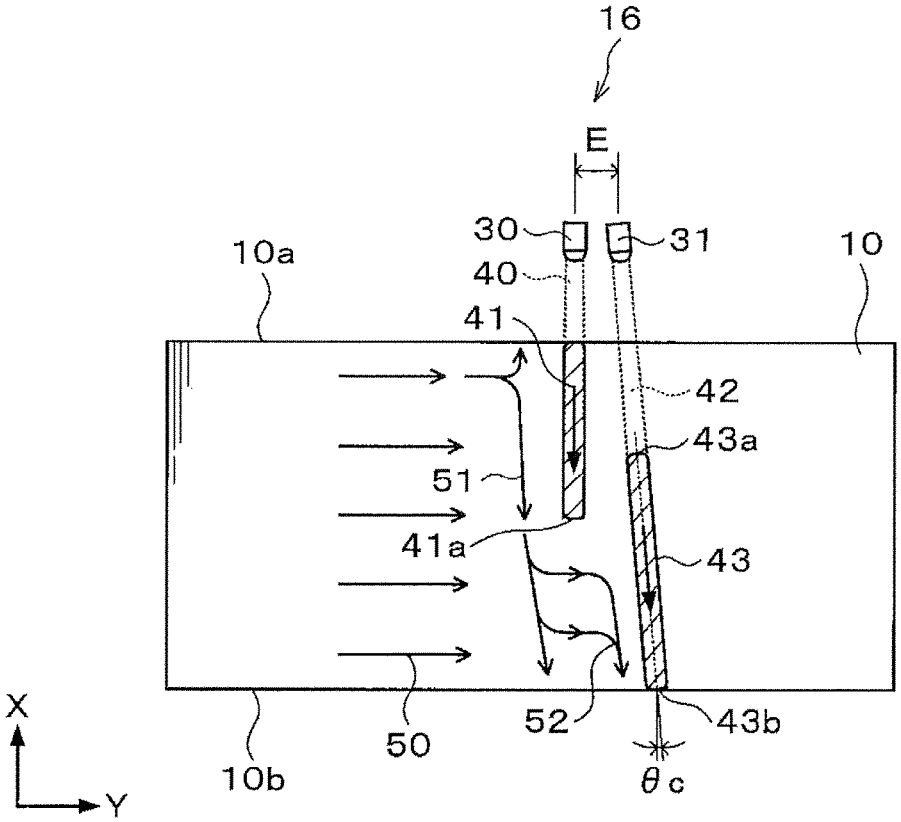
FIG. 4 is a plain view showing an overview of the configuration of the water removing apparatus.

Next, the configuration of the water removing apparatus 16 mentioned above is described. The water removing apparatus 16 comprises, as shown in FIG. 2 to FIG. 4, two water removing nozzles 30 and 31 that jet water-removing water to the upper surface of the hot rolling steel sheet 10. The water removing nozzles 30 and 31 are placed on the lateral side of one end in the width direction (the end on the positive X-direction side in the drawing) of the pass line of the hot rolling steel sheet 10 (hereinafter, referred to as a steel sheet conveyance plane). The steel sheet conveyance plane is on a line connecting the apices of the conveyor rolls 18 in the side view, and is a conveyance plane in the case where, in the planar view, the dimension in the width direction of the hot rolling steel sheet 10 is the maximum producible dimension. Therefore, the water removing nozzles 30 and 31 are always placed on the lateral side of the one end in the width direction of the hot rolling steel sheet 10, that is, are not placed right above the hot rolling steel sheet 10. In the following description, it is assumed that the width of the steel sheet conveyance plane and the width of the hot rolling steel sheet 10 coincide. Each numerical value is defined on the steel sheet conveyance plane; the hot rolling steel sheet 10 has a prescribed thickness of approximately 1.0 mm to 30 mm, which is almost the same as the value defined on the steel sheet conveyance plane. One end 10*a* of the hot rolling steel sheet 10 at which the water removing nozzles 30 and 31 are placed may be referred to as a near end 10*a*, and the other end 10*b* (the end on the negative X-direction side in the drawing) facing the near end 10*a* may be referred to as a far end 10*b*. The water removing nozzles 30 and 31 are aligned in the conveyance direction of the hot rolling steel sheet 10.

As the near water removing nozzle 30, for example, a flat spay nozzle is used; the near water removing nozzle 30 jets a jet flow of water-removing water to the steel sheet at a spread angle θa of, for example, 30 degrees to 70 degrees in such a manner that the angle between a plane including the flat spaying plane and the steel sheet plane is not less than 80 degrees and not more than 100 degrees. Hereinafter, the jet flow of water-removing water jetted from the near water removing nozzle 30 is referred to as a near jet flow 40. The near jet flow 40 collides with the surface of the hot rolling steel sheet 10, and a near end water removal single area 41 (hereinafter, referred to as simply a near area 41) that is the area of collision of water-removing water spreading from the near end 10*a* to the center side (a water removal single area) is formed on the surface of the hot rolling steel sheet 10. The near area 41 includes the near end 10*a*, but does not include the far end 10*b*. The near area 41 is formed such that, in a planar view, its long axis has an angle of −15 degrees to 15 degrees with the width direction of the hot rolling steel sheet 10. Here, with regard to the plus or minus sign, the angle to the direction of the jet flow at the downstream side in the running direction of the steel sheet is defined as plus.

As the far water removing nozzle 31, for example, a flat spay nozzle is used; the far water removing nozzle 31 jets a jet flow of water-removing water to the steel sheet at a spread angle θb of, for example, 10 degrees to 20 degrees, which is smaller than the spread angle θa of the near jet flow 40 in such a manner that the angle between a plane including the flat spaying plane and the steel sheet plane is not less than 80 degrees and not more than 100 degrees. Hereinafter, the jet flow of water-removing water jetted from the far water removing nozzle 31 is referred to as a far jet flow 42. If the spread angle θb of the far jet flow 42 is large, the force of pushing out cooling water is weak as described later; thus, the spread angle θb is set to, for example, 10 degrees to 20 degrees as described above. The far jet flow 42 collides with the surface of the hot rolling steel sheet 10, and a far end water removal single area 43 (hereinafter, referred to as simply a far area 43) that is the area of collision of water-removing water spreading from the far end 10*b* to the center side (a water removal single area) is formed. The far area 43 includes the far end 10*b*, but does not include the near end 10*a*. The far area 43 is formed such that its far-end-side end 43*b* is located closer to the downstream side than its center-side end 43*a*, that is, formed such that, in a planar view, its long axis is inclined from the width direction of the hot rolling steel sheet 10 by a prescribed angle θc of, for example 5, degrees. The angle θc is not limited to that of the embodiment, and is set arbitrarily in the range of 0 degrees to 15 degrees. This is because, if the angle θc is 0 degrees or less, water may leak to the opposite side to the direction of the flow of the far area 43. If the angle θc is 15 degrees or more, the area where the cooling water 50 flows is different between the near end 10*a* side and the far end 10*b* side, and the temperature uniformity in the width direction of the steel sheet is worsened.

The water removing nozzles 30 and 31 are arranged such that the near area 41 and the far area 43 cover the entire area in the width direction of the hot rolling steel sheet 10. The near water removing nozzle 30 is placed closer to the upstream side in the conveyance direction, that is, closer to the upstream side of the flow of cooling water than the far water removing nozzle 31. That is, the near area 41 is formed in a manner that the near area 41 is closer to the upstream side than the far area 43. The near water removing nozzle 30 is placed in a higher position in the vertical direction than the far water removing nozzle 31.

Next, a method of removing cooling water using the water removing apparatus 16 configured as described above is described. In FIG. 4, the arrows on the hot rolling steel sheet 10 indicate the flows of cooling water 50 and discharging waters 51 and 52 after the cooling water hits the near area 41 and the far area 43.

The cooling water 50 on the hot rolling steel sheet 10 is intercepted by the near jet flow 40 from the near water removing nozzle 30. At this time, the speed of the discharging water 51 in the near area 41 becomes slower, and accordingly the height of the discharging water 51 becomes higher. The discharging water 51 is blocked by the near area 41, and part of the discharging water 51 is discharged to the near end 10*a* side and the rest is pushed out to the far end 10*b* side of the hot rolling steel sheet 10. Part of the pushed out discharging water 51 is discharged to the lateral side of the far end 10*b*. On the other hand, the rest of the discharging water 51 flows from between the near area 41 and the far end 10*b* to the far area 43 side.

Then, the discharging water 52 that has flowed from the near area 41 is blocked by the far area 43 formed by the far jet flow 42 from the far water removing nozzle 31, is pushed out to the far end 10*b* side, and is discharged from the far end 10*b* to the lateral side. At this time, the speed of the discharging water 52 is faster than the speed of the discharging water 51 in the near area 41, and the height of the discharging water 52 is lower. Therefore, even when the height of the far jet flow 42 is low, a speed in the width direction can be given to the discharging water 52, and the discharging water 52 is discharged from the far end 10*b* appropriately. Since as described above the far area 43 is formed at an angle such that the far-end-side end 43*b* is located closer to the downstream side than the center-side end 43*a*, the cooling water 50 is smoothly discharged from the far end 10*b*. Therefore, the cooling water 50 does not flow to the downstream side of the far area 43. Thus, the removal of the cooling water 50 is continuously performed from the near end 10*a* to the far end 10*b*.

In the removal of the cooling water 50, the sum total of the momenta of the water removing nozzles 30 and 31 is a momentum exceeding a momentum that is enough to change the direction of the flow at a prescribed flow rate of the cooling water that flows on the hot rolling steel sheet from the upstream side in the conveyance direction, to the directions toward the ends of the steel sheet. Therefore, the removal of the cooling water 50 is performed more appropriately by the water removing apparatus 16.

Thus, according to the embodiment the removal of the cooling water 50 can be performed appropriately even when the cooling water 50 has a large water flow density of 1.0 to 10 $m^3/m^2/min$.

The near jet flow 40 from the near water removing nozzle 30 mainly has the function of intercepting cooling water, and the far jet flow 42 from the far water removing nozzle 31 mainly has the function of pushing out cooling water. By thus separating the functions of the near water removing nozzle 30 and the far water removing nozzle 31, the amount of water-removing water jetted from each of the water removing nozzles 30 and 31 can be reduced. Therefore, the water removal efficiency of the cooling water 50 can be improved.

Furthermore, the two water removing nozzles 30 and 31 are placed on the lateral side of the near end 10*a* of the hot rolling steel sheet 10, and the installation space is small. Therefore, the installation flexibility of the water removing apparatus 16 is high, and the placement of the cooling apparatus 15 is not influenced by the water removing apparatus 16. Therefore, the cooling performance on the hot rolling steel sheet 10 can be ensured appropriately.

Although the case of the large amount of the cooling water 50 is described in the above embodiment, the present invention can be applied also to the case of removing a small amount of cooling water. In such a case, a small amount of cooling water can be removed appropriately by the same principle as above. Furthermore, the amount of water-removing water can be reduced, and the water removal efficiency of cooling water can be improved.

Next, the present inventors conducted studies on more preferred conditions of the water removing apparatus 16. Thus, it has been found that the removal of cooling water can be performed more appropriately when a first condition to a fifth condition described below are satisfied.

(1) First condition: the ratio of the distance in the width direction of the near area 41 to the width of the hot rolling steel sheet 10 (hereinafter, referred to as a near area width A; see FIG. 3) be more than 0.2 and less than 0.6.

(2) Second condition: the ratio of the distance in the width direction of the overlapping area of the near area 41 and the far area 43 to the width of the hot rolling steel sheet 10 (hereinafter, referred to as an overlapping width B; see FIG. 3) be more than 0.0 and less than 0.2.

(3) Third condition: the angle between the near jet flow 40 and the hot rolling steel sheet 10 at the center-side end 41*a* of the near area 41 (hereinafter, referred to as a near jet flow angle C; see FIG. 3) be more than 15 degrees and less than 50 degrees.

(4) Fourth condition: the angle between the far jet flow 42 and the hot rolling steel sheet 10 at the center-side end 43*a* of the far area 43 (hereinafter, referred to as a far jet flow angle D; see FIG. 3) be more than 10 degrees and less than 30 degrees.

(5) Fifth condition: the ratio of the distance in the conveyance direction between the near water removing nozzle 30 and the far water removing nozzle 31 (hereinafter, referred to as an inter-nozzle distance E; see FIG. 4) to the distance in the conveyance direction between the centers of a pair of conveyor rolls 18 and 18 adjacent in the conveyance direction (hereinafter, referred to as a roll pitch) be larger than 0.25.

The bases of the thresholds of the first condition to the fifth condition are described in detail in Examples described later, including specific flows of cooling water.

Further, the present inventors have found that the uniformity of cooling of the hot rolling steel sheet 10 can be improved when a sixth condition described below is satisfied.

(6) Sixth condition: the inter-nozzle distance E be less than 0.95.

Figure 5:
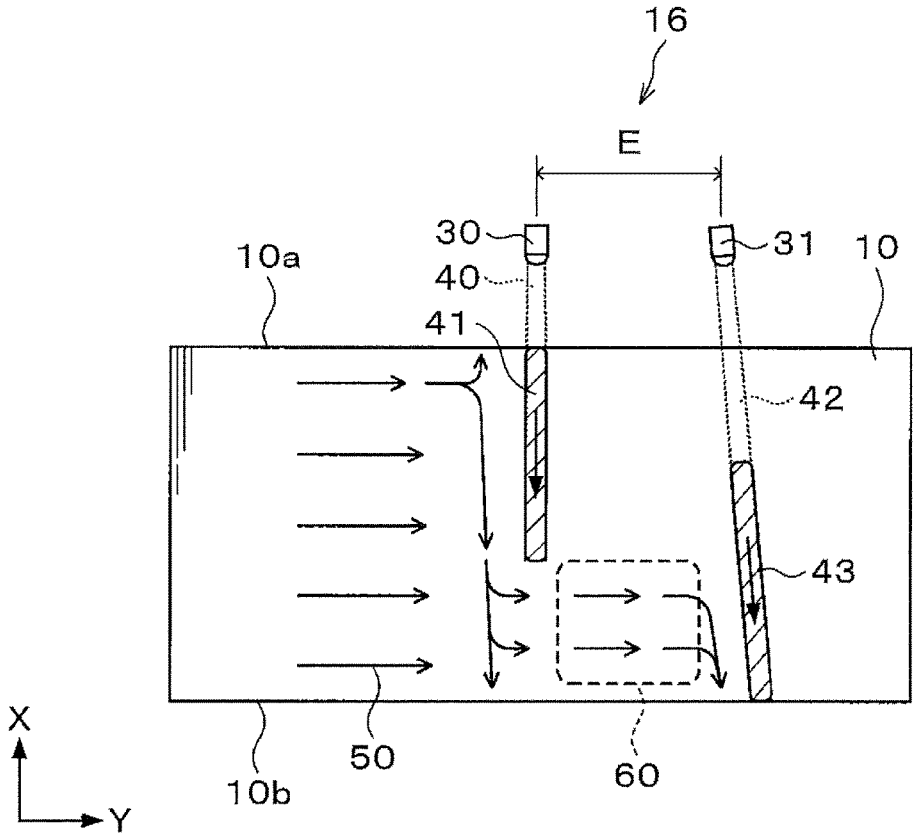
FIG. 5 is an illustration diagram of a case where a sixth condition (described later) is not satisfied.

If the inter-nozzle distance E is large as shown in FIG. 5, a certain space 60 is formed between the near area 41 and the far area 43. Consequently, the cooling water 50 that has flowed from the near area 41 cools the hot rolling steel sheet 10 in the space 60. That is, the hot rolling steel sheet 10 is excessively cooled in the space 60, and the cooling of the hot rolling steel sheet 10 is made non-uniform. Furthermore, if the inter-nozzle distance E is large, the near water removing nozzle 30 or the far water removing nozzle 31 may interfere with another apparatus, and there is a problem in terms of the facility.

In this respect, when the sixth condition mentioned above is satisfied, the space 60 can be minimized, and the hot rolling steel sheet 10 can be uniformly cooled in the width direction. Therefore, the material quality of the hot rolling steel sheet 10 can be made uniform, and the deformation situation during processing is lessened. With the same typical strength, the amount of alloy for strength improvement can be reduced because a part where the material quality is reduced is not present; thus, a hot rolling steel sheet 10 with a low cost and a low environmental load during recycling can be provided. In addition, the near water removing nozzle 30 and the far water removing nozzle 31 can be closely arranged, and the installation space is small; therefore, the problem in terms of the facility described above can be eliminated.

4. Other Embodiments

Next, other embodiments of the water removing apparatus 16 are described.

4-1. Another Embodiment

Figure 6:
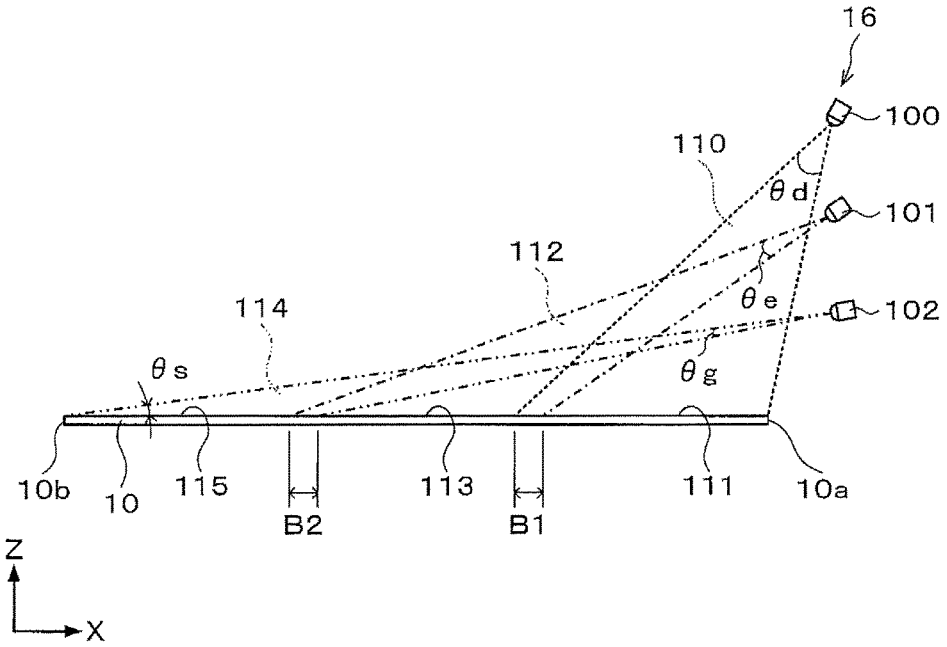
FIG. 6 is a side view showing an overview of the configuration of a water removing apparatus in another embodiment.
Figure 7:
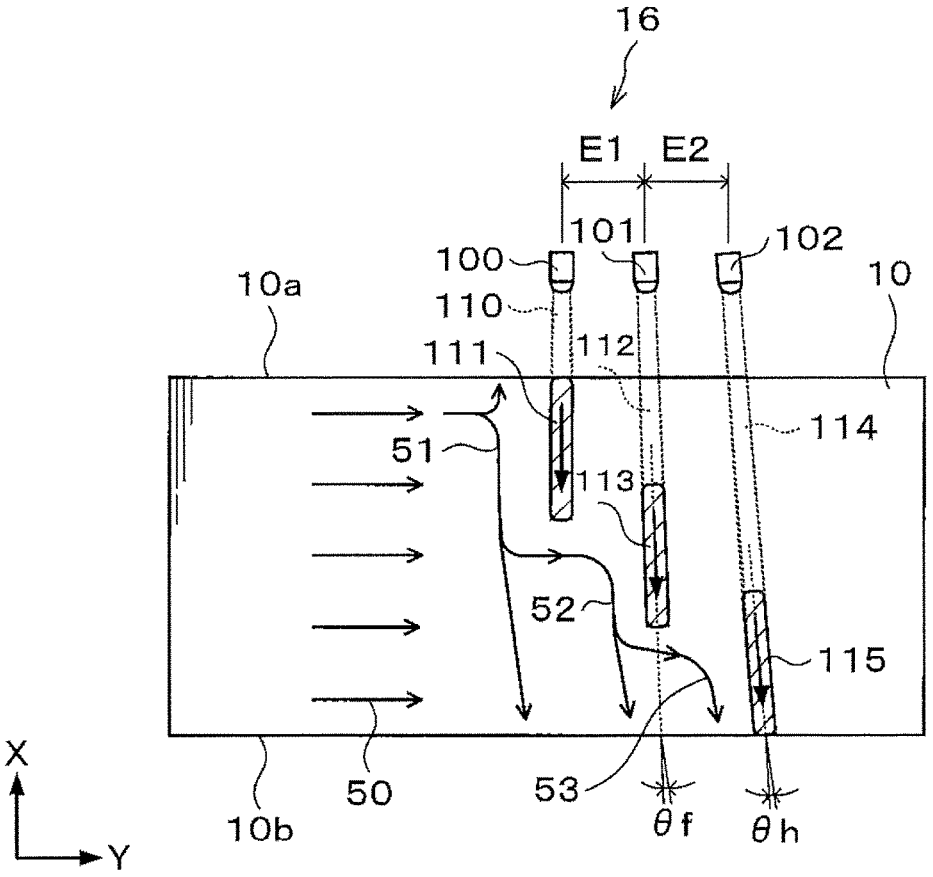
FIG. 7 is a plain view showing an overview of the configuration of the water removing apparatus in the other embodiment.

In the water removing apparatus 16 of the above embodiment, the two water removing nozzles 30 and 31 are placed on the lateral side of the near end 10*a* of the hot rolling steel sheet 10; but three or more water removing nozzles may be placed. For example, as shown in FIG. 6 and FIG. 7, three water removing nozzles 100 to 102 are aligned in this order in the conveyance direction of the hot rolling steel sheet 10 on the lateral side of the near end 10*a* of the hot rolling steel sheet 10.

As the near water removing nozzle 100, for example, a flat spay nozzle is used; the near water removing nozzle 100 jets a jet flow of water-removing water at a spread angle θd of, for example, 20 degrees to 50 degrees. Hereinafter, the jet flow of water-removing water jetted from the near water removing nozzle 100 is referred to as a near jet flow 110. The near jet flow 110 collides with the surface of the hot rolling steel sheet 10, and a near end water removal single area 111 (hereinafter, referred to as a near area 111) that is the area of collision of water-removing water (a water removal single area) is formed on the surface of the hot rolling steel sheet 10. The near area 111 includes the near end 10*a*, but does not include the far end 10*b*. The near area 111 is formed such that, in a planar view, its long axis has an angle of −10 degrees to 10 degrees with the width direction of the hot rolling steel sheet 10.

As the inner water removing nozzle 101, for example, a flat spay nozzle is used; the inner water removing nozzle 101 jets a jet flow of water-removing water at a spread angle θe of, for example 10 degrees to 40 degrees, which is smaller than the spread angle θd of the near jet flow 110. Hereinafter, the jet flow of water-removing water jetted from the inner water removing nozzle 101 is referred to as an inner jet flow 112. The inner jet flow 112 collides with the surface of the hot rolling steel sheet 10, and an inner water removal single area 113 (hereinafter, referred to as an inner area 113) that is the area of collision of water-removing water (a water removal single area) is formed on the surface of the hot rolling steel sheet 10. The inner area 113 does not include either of the near end 10*a* and the far end 10*b*. The inner area 113 is formed such that its far-end-side end is located closer to the downstream side than its center-side end, that is, formed such that, in a planar view, its long axis is inclined from the width direction of the hot rolling steel sheet 10 by a prescribed angle θf of, for example 2, degrees. The angle θf is not limited to that of the embodiment, and is set to 0 degrees to 10 degrees.

As the far water removing nozzle 102, for example, a flat spay nozzle is used; the far water removing nozzle 102 jets a jet flow of water-removing water at a spread angle θg of, for example 5 degrees to 30 degrees, which is smaller than the spread angle θe of the inner jet flow 112. Hereinafter, the jet flow of water-removing water jetted from the far water removing nozzle 102 is referred to as a far jet flow 114. The far jet flow 114 collides with the surface of the hot rolling steel sheet 10, and a far end water removal single area 115 (hereinafter, referred to as simply a far area 115) that is the area of collision of water-removing water (a water removal single area) is formed on the surface of the hot rolling steel sheet 10. The far area 115 includes the far end 10*b*, but does not include the near end 10*a*. The far area 115 is formed such that its far-end-side end is located closer to the downstream side than its center-side end, that is, formed such that, in a planar view, its long axis is inclined from the width direction of the hot rolling steel sheet 10 by a prescribed angle θh of, for example, 5 degrees. The angle θh is not limited to that of the embodiment, and is set to 0 degrees to 10 degrees. If the installation position of the far water removing nozzle 102 is too low, the cooling water 50 may go over the far jet flow 114 and flow to the downstream side; thus, the far water removing nozzle 102 is preferably placed such that the angle θs between the far jet flow 114 and the hot rolling steel sheet 10 is larger than, for example, 10 degrees.

In the embodiment, the inner water removing nozzle 101 and the far water removing nozzle 102 constitute a far water removing nozzle group of the present invention.

The near area 111, the inner area 113, and the far area 115 individually cover three areas of the upper surface of the hot rolling steel sheet 10 that are three areas divided in the width direction, that is, divided in the same number as the water removing nozzles 100 to 102. The near area 111 and the inner area 113 adjacent in the width direction overlap in the width direction, and similarly the inner area 113 and the far area 115 overlap in the width direction. The near area 111, the inner area 113, and the far area 115 cover the entire area in the width direction of the hot rolling steel sheet 10. Further, the near area 111, the inner area 113, and the far area 115 are formed so as to be aligned in this order from the near end 10*a* side to the far end 10*b* side of the hot rolling steel sheet 10. Further, the near area 111, the inner area 113, and the far area 115 are formed so as to be aligned in this order from the upstream side to the downstream side in the conveyance direction.

In the embodiment, the second condition, the fifth condition, and the sixth condition described above are satisfied.

(2) Second condition: each of the ratio of the distance in the width direction of the overlapping area of the near area 111 and the inner area 113 to the width of the hot rolling steel sheet 10 (hereinafter, referred to as an overlapping width B1; see FIG. 6) and the ratio of the distance in the width direction of the overlapping area of the inner area 113 and the far area 115 to the width of the hot rolling steel sheet 10 (hereinafter, referred to as an overlapping width B2; see FIG. 6) be more than 0.0 and less than 0.2. The overlapping width B1 and the overlapping width B2 may be different.

(5) Fifth condition: each of the ratio of the distance in the conveyance direction between the near water removing nozzle 100 and the inner water removing nozzle 101 (hereinafter, referred to as an inter-nozzle distance E1; see FIG. 7) to the roll pitch and the ratio of the distance in the conveyance direction between the inner water removing nozzle 101 and the far water removing nozzle 102 (hereinafter, referred to as an inter-nozzle distance E2; see FIG. 7) to the roll pitch be larger than 0.25.

(6) Sixth condition: each of the inter-nozzle distances E1 and E2 be less than 0.95. The sixth condition is, as described above, a condition for minimizing the space 60 shown in FIG. 5 to uniformly cool the hot rolling steel sheet 10 in the width direction. Thus, although in the drawings of the following embodiments it may appear that the space 60 is formed for convenience of illustration, in practice the space 60 is minimized.

In such a case, as shown in FIG. 7, the cooling water 50 on the hot rolling steel sheet 10 is blocked by the near area 111, and part of the cooling water 50 is discharged to the near end 10*a* side and the rest is pushed out to the far end 10*b* side of the hot rolling steel sheet 10. Part of the pushed out discharging water 51 is discharged to the lateral side of the far end 10*b*; on the other hand, the rest of the discharging water 51 flows to the inner area 113 side.

Subsequently, the discharging water 52 that has flowed from the near area 111 is blocked by the inner area 113, and is pushed out to the far end 10*b* side of the hot rolling steel sheet 10. Part of the pushed out discharging water 52 is discharged to the lateral side of the far end 10*b*; on the other hand, the rest of the discharging water 52 flows to the far area 115 side. At this time, since the inner area 113 is formed at an angle as described above, the discharging water 52 is smoothly discharged from the far end 10*b*.

The discharging water 53 that has flowed from the inner area 113 is blocked by the far area 115, is pushed out to the far end 10*b* side, and is discharged from the far end 10*b* to the lateral side. At this time, since the far area 115 is formed at an angle as described above, the discharging water 53 is smoothly discharged from the far end 10*b*. Thus, the removal of the cooling water 50 is continuously performed from the near end 10*a* to the far end 10*b*.

In the removal of the cooling water 50, the sum total of the momenta of the water removing nozzles 100 to 102 is a momentum exceeding a momentum that is enough to change the direction of the flow at a prescribed flow rate of the cooling water that flows on the hot rolling steel sheet from the upstream side in the conveyance direction, to the directions toward the ends of the steel sheet. Therefore, the removal of the cooling water 50 is performed more appropriately by the water removing apparatus 16.

Also in the embodiment, similar effects to the embodiment described above can be exhibited. That is, the near jet flow 110 and the inner jet flow 112 mainly have the function of intercepting cooling water, and the far jet flow 114 mainly has the function of pushing out cooling water. By thus separating the functions of the water removing nozzles 100 to 102, the amount of water-removing water jetted from each of the water removing nozzles 100 to 102 is reduced. Even when the cooling water 50 has a large water flow density, the removal of the cooling water 50 can be performed appropriately.

In the case where a plurality of water removing nozzles 100 to 102 are placed on the lateral side of the near end 10*a* of the hot rolling steel sheet 10, in order to perform the removal of the cooling water 50 appropriately, it is necessary that the near area 111, the inner area 113, and the far area 115 be formed so as to be aligned in this order in the conveyance direction of the hot rolling steel sheet 10 and be aligned in this order from the near end 10*a* side to the far end 10*b* side, as described above.

Figure 8:
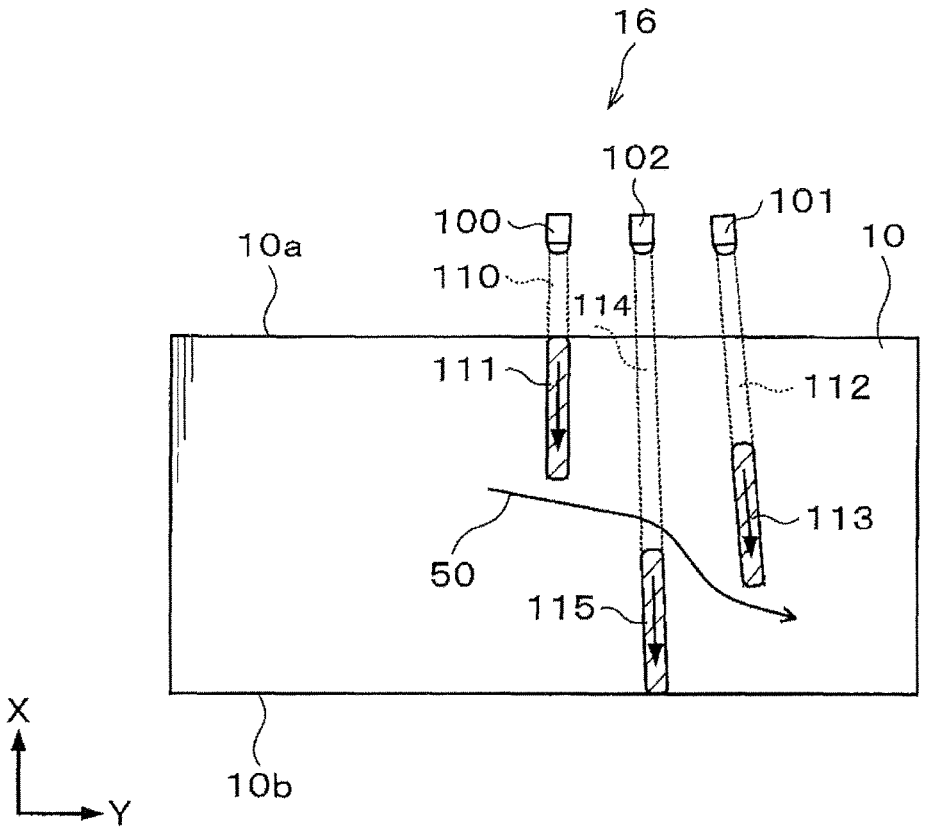
FIG. 8 is an illustration diagram showing an example in which the removal of cooling water is not performed appropriately.

In the case where, for example as shown in FIG. 8, the near area 111, the far area 115, and the inner area 113 are formed to be aligned in this order in the conveyance direction, even when the second condition is satisfied, the cooling water that has flowed from between the near area 111 and the far area 115 may pass through between the inner area 113 and the far end 10*b* and flow to the downstream side.

Figure 9:
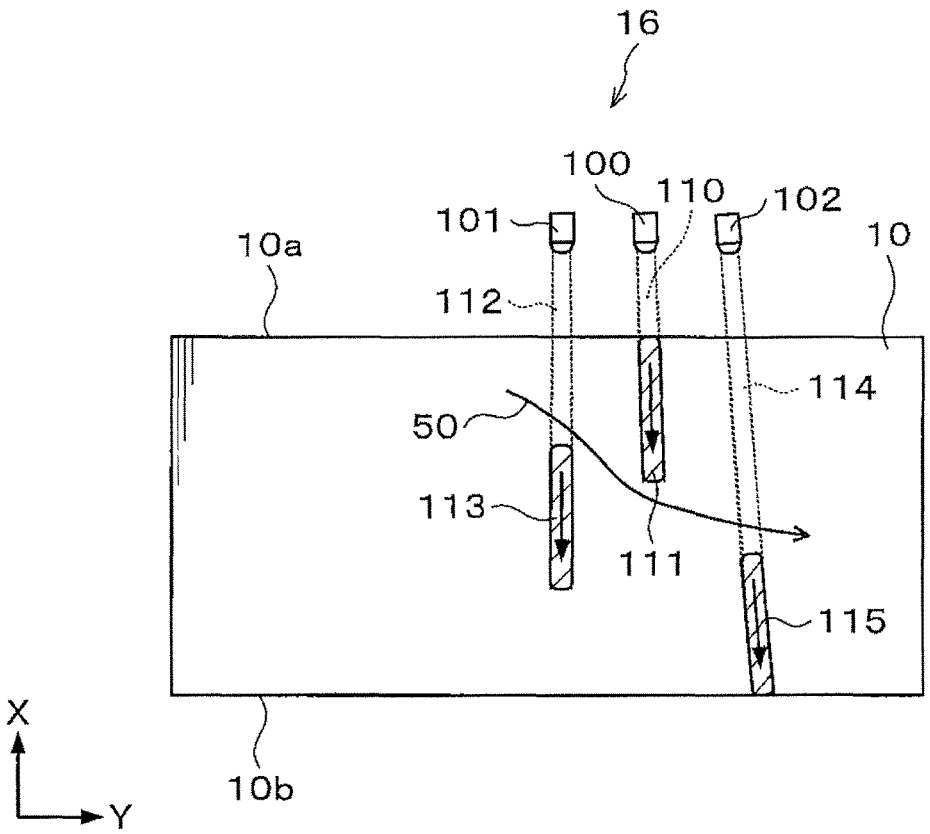
FIG. 9 is an illustration diagram showing an example in which the removal of cooling water is not performed appropriately.

In the case where, for example as shown in FIG. 9, the inner area 113, the near area 111, and the far area 115 are formed to be aligned in this order in the conveyance direction, even when the second condition is satisfied, the cooling water that has flowed from between the inner area 113 and the near area 111 may pass through between the far area 115 and the near end 10*a* and flow to the downstream side.

Figure 10:
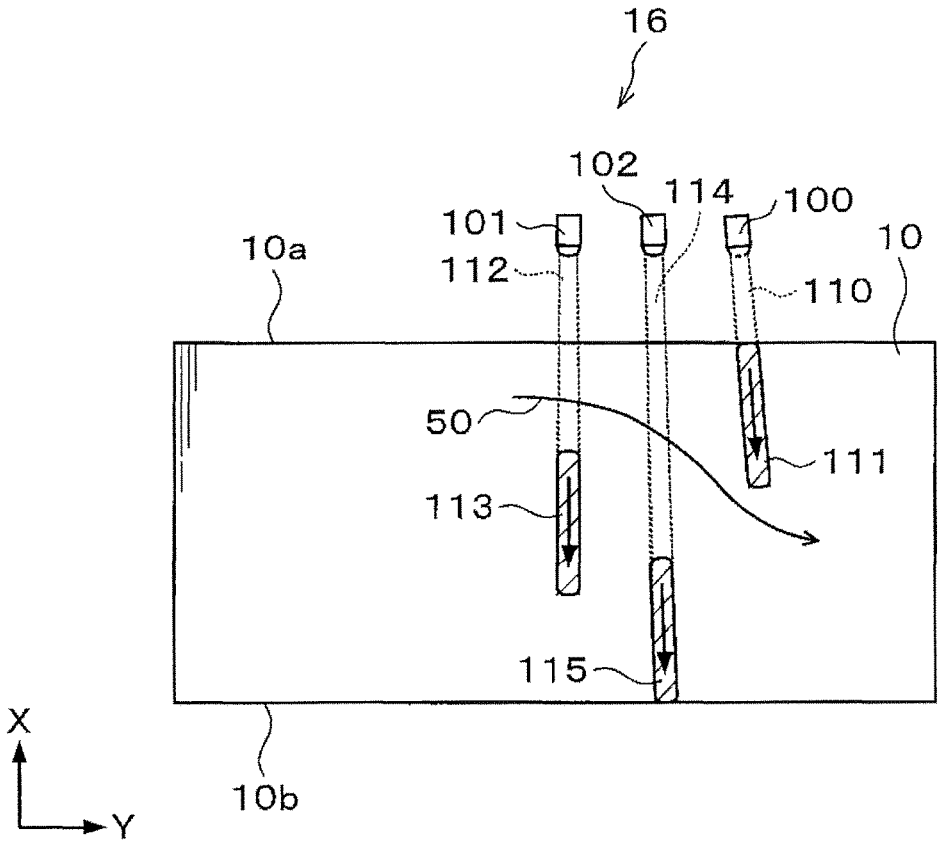
FIG. 10 is an illustration diagram showing an example in which the removal of cooling water is not performed appropriately.

In the case where, for example as shown in FIG. 10, the inner area 113, the far area 115, and the near area 111 are formed to be aligned in this order in the conveyance direction, even when the second condition is satisfied, the cooling water that has flowed from between the far area 115 and the near end 10*a* may pass through between the near area 111 and the far end 10*b* and flow to the downstream side.

In the case where, like above, the near area 111, the inner area 113, and the far area 115 are not aligned in this order in the conveyance direction of the hot rolling steel sheet 10, even when the second condition is satisfied, there is a case where the removal of the cooling water 50 cannot be performed appropriately.

Figure 11:
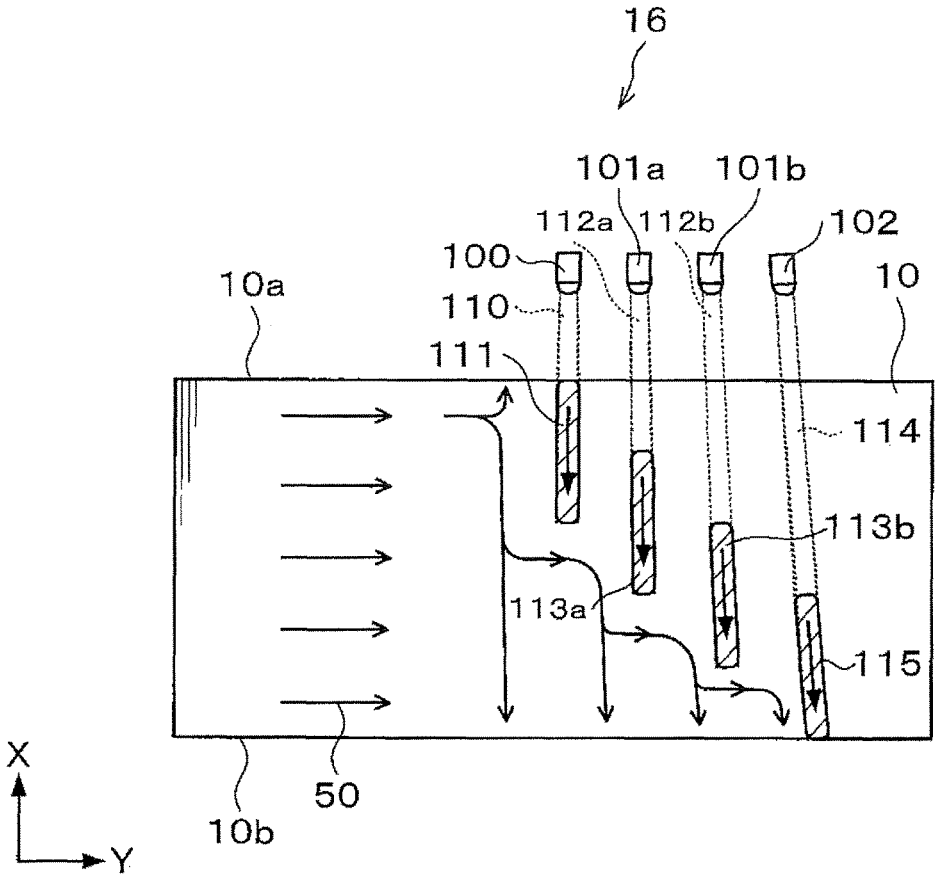
FIG. 11 is a plain view showing an overview of the configuration of a water removing apparatus in another embodiment.

Although in the above embodiment one inner water removing nozzle 101 is provided in the far water removing nozzle group, two or more inner water removing nozzles 101 may be provided. For example, as shown in FIG. 11, two inner water removing nozzles 101*a* and 101*b* are arranged in this order in the conveyance direction between the near water removing nozzle 100 and the far water removing nozzle 102. The inner water removing nozzles 101*a* and 101*b* jet inner jet flows 112*a* and 112*b*, respectively, and form inner areas 113*a* and 113*b* in such a manner that the inner areas 113*a* and 113*b* are aligned in this order from the near end 10*a* side to the far end 10*b* side. Also in such a case, similar effects to the embodiment described above can be exhibited; that is, even when the cooling water 50 has a large water flow density, the removal of the cooling water 50 can be performed appropriately.

Although in the above embodiments one single far water removing nozzle 31 is provided in FIG. 4 and one far water removing nozzle group (the water removing nozzles 101 and 102) is provided in FIG. 7 and FIG. 11, two or more single far water removing nozzles 31 or two or more far water removing nozzle groups may be provided. Further, a single far water removing nozzle 31 and a single far water removing nozzle group illustrated may be placed in combination.

4-2. Another Embodiment

Figure 12:
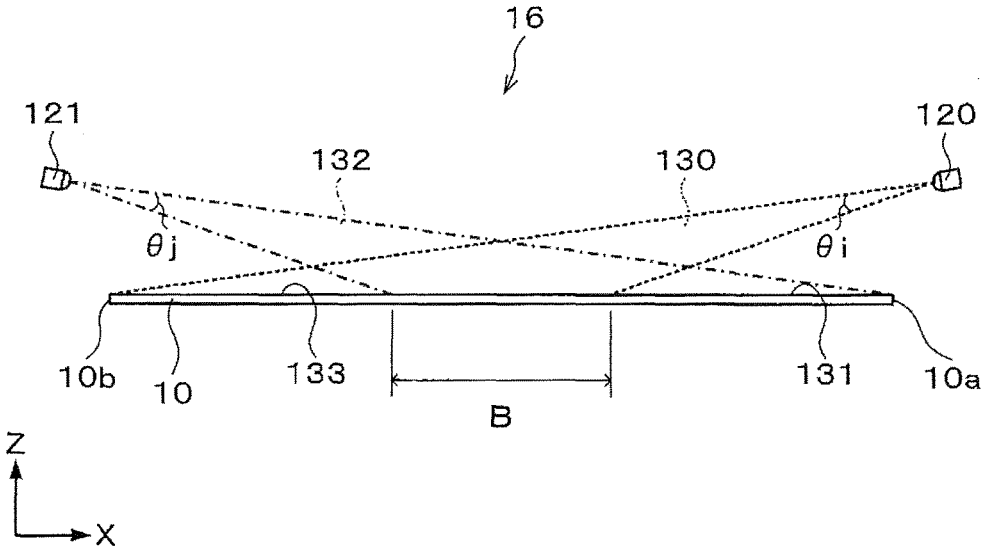
FIG. 12 is a side view showing an overview of the configuration of a water removing apparatus in another embodiment.
Figure 13:
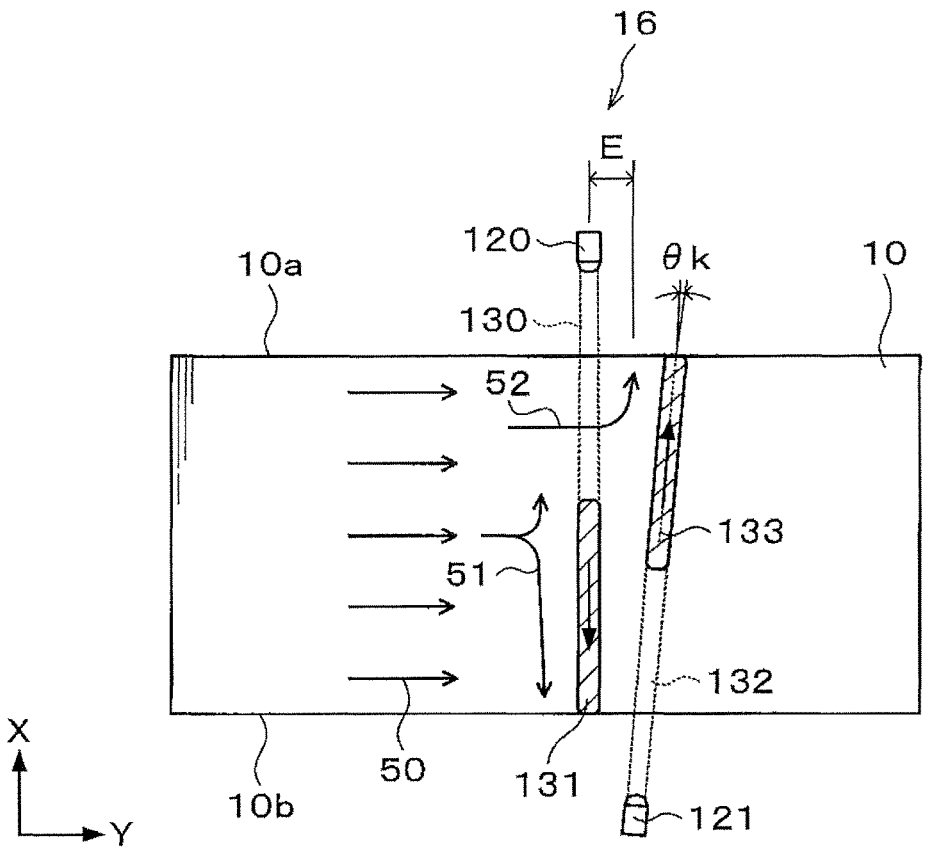
FIG. 13 is a plain view showing the overview of the configuration of the water removing apparatus in the other embodiment.

Although in the water removing apparatus 16 of the above embodiments the water removing nozzles 30 and 31 are placed on the lateral side of the one end 10*a* of the hot rolling steel sheet 10, water removing nozzles may be placed on the lateral side of both sides of the hot rolling steel sheet 10. For example, as shown in FIG. 12 and FIG. 13, a first water removing nozzle 120 is placed on the lateral side of the one end 10*a* of the hot rolling steel sheet 10, and a second water removing nozzle 121 is placed on the lateral side of the other end 10*b*. The water removing nozzles 120 and 121 are aligned in this order in the conveyance direction of the hot rolling steel sheet 10. Both the water removing nozzles 120 and 121 correspond to a far water removing nozzle of the present invention.

As the first water removing nozzle 120, for example, a flat spay nozzle is used; the first water removing nozzle 120 jets a jet flow of water-removing water at a spread angle θi of, for example, 5 degrees to 40 degrees. Hereinafter, the jet flow of water-removing water jetted from the first water removing nozzle 120 is referred to as a first jet flow 130. The first jet flow 130 collides with the surface of the hot rolling steel sheet 10, and a first water removal single area 131 that is the area of collision of water-removing water is formed on the surface of the hot rolling steel sheet 10. The first water removal single area 131 (a far end water removal single area) is formed such that, in a planar view, its long axis has an angle of 0 degrees to 10 degrees with the width direction of the hot rolling steel sheet 10.

As the second water removing nozzle 121, for example, a flat spay nozzle is used; the second water removing nozzle 121 jets a jet flow of water-removing water at a spread angle θj of, for example, 5 degrees to 30 degrees. Hereinafter, the jet flow of water-removing water jetted from the second water removing nozzle 121 is referred to as a second jet flow 132. The second jet flow 132 collides with the surface of the hot rolling steel sheet 10, and a second water removal single area 133 (a far end water removal single area) that is the area of collision of water-removing water is formed on the surface of the hot rolling steel sheet 10. The second water removal single area 133 is formed such that its one-end-side end is located closer to the downstream side than its center-side end, that is, formed such that, in a planar view, its long axis is inclined from the width direction of the hot rolling steel sheet 10 by a prescribed angle θk of, for example, 5 degrees. The angle θk is not limited to that of the embodiment, and is set to 0 degrees to 10 degrees.

The first water removal single area 131 extends from the other end 10*b* to the center side, and the second water removal single area 133 extends from the one end 10*a* to the center side. The first water removal single area 131 and the second water removal single area 133 overlap in the width direction, and cover the entire area in the width direction of the hot rolling steel sheet 10. In the embodiment, the second condition, the fifth condition, and the sixth condition described above are satisfied.

In such a case, as shown in FIG. 13, the cooling water 50 on the hot rolling steel sheet 10 is blocked by the first water removal single area 131, is pushed out to the other end 10*b* side of the hot rolling steel sheet 10, and is discharged to the lateral side of the other end 10*b*. The cooling water 50 and the discharging water 51 that have flowed from between the first water removal single area 131 and the one end 10*a* are blocked by the second water removal single area 133, are pushed out to the one end 10*a* side of the hot rolling steel sheet 10, and are discharged to the lateral side of the one end 10*a*. Thus, the removal of the cooling water 50 is performed.

In the removal of the cooling water 50, the sum total of the momenta of the water removing nozzles 120 and 121 is a momentum exceeding a momentum that is enough to change the direction of the flow at a prescribed flow rate of the cooling water that flows on the hot rolling steel sheet from the upstream side in the conveyance direction to the directions toward the ends of the steel sheet. Therefore, the removal of the cooling water 50 is performed more appropriately by the water removing apparatus 16.

Also in the embodiment, similar effects to the embodiment described above can be exhibited; that is, even when the cooling water 50 has a large water flow density, the removal of the cooling water 50 can be performed appropriately.

In addition, since the first jet flow 130 from the first water removing nozzle 120 on the lateral side of the one end 10*a* is not directly jetted to the one end 10*a*, an excessive temperature decrease of the hot rolling steel sheet 10 at the one end 10*a* can be suppressed. Similarly, since the second jet flow 132 from the second water removing nozzle 121 on the lateral side of the other end 10*b* is not directly jetted to the other end 10*b*, an excessive temperature decrease of the hot rolling steel sheet 10 at the other end 10*b* can be suppressed. Therefore, temperature unevenness in the width direction of the hot rolling steel sheet 10 can be prevented, and a uniform steel sheet can be produced.

Furthermore, the spread angle θi of the first jet flow 130 and the spread angle θj of the second jet flow 132 may be reduced, and thereby the momentum that transports water-removing water from each of the water removing nozzles 120 and 121 to the hot rolling steel sheet 10 can be increased; thus, the water removal performance is increased.

4-3. Another Embodiment

Figure 14:
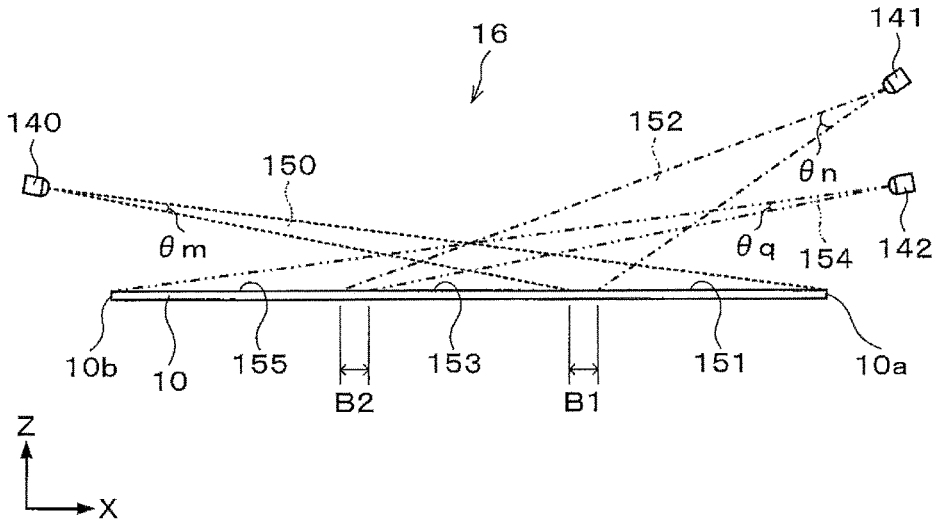
FIG. 14 is a side view showing an overview of the configuration of a water removing apparatus in another embodiment.
Figure 15:
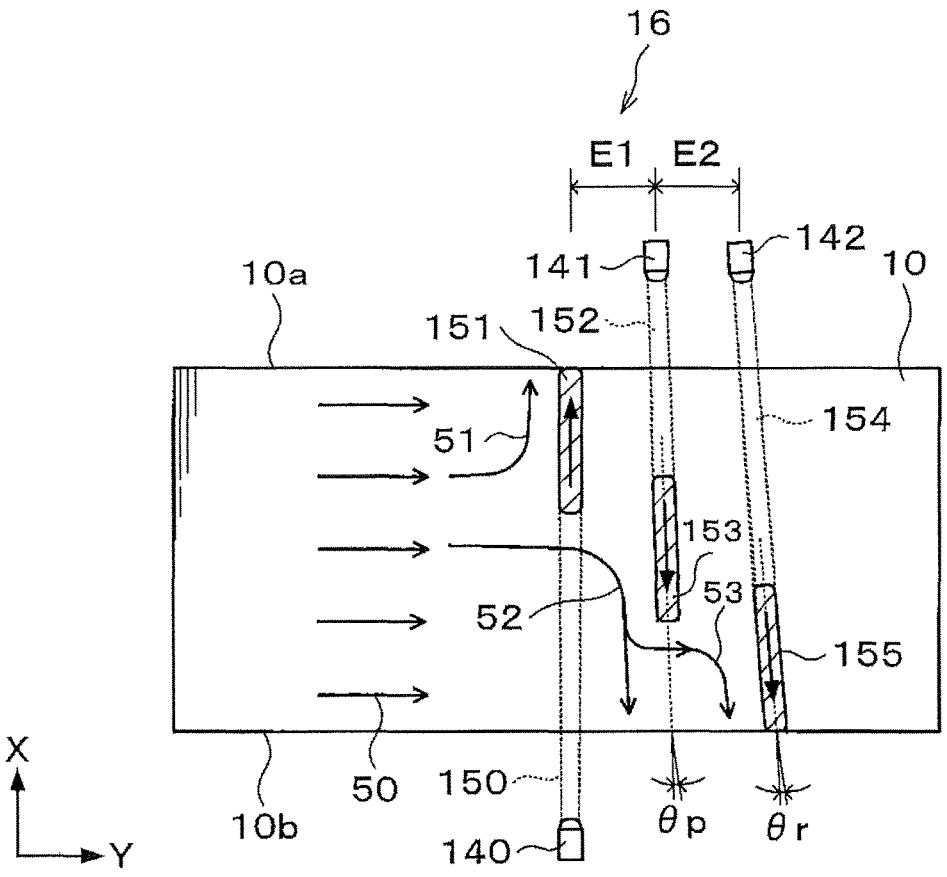
FIG. 15 is a plain view showing the overview of the configuration of the water removing apparatus in the other embodiment.

Although in the water removing apparatus 16 of the above embodiment the two water removing nozzles 120 and 121 are placed on the lateral side of both sides of the hot rolling steel sheet 10, three or more water removing nozzles may be placed. For example, as shown in FIG. 14 and FIG. 15, a first water removing nozzle 140 is placed on the lateral side of the other end 10*b* of the hot rolling steel sheet 10, and a second water removing nozzle 141 and a third water removing nozzle 142 are placed on the lateral side of the one end 10*a*. The water removing nozzles 140 to 142 are aligned in this order in the conveyance direction of the hot rolling steel sheet 10. The first water removing nozzle 140 corresponds to a single far water removing nozzle of the present invention. Further, the second water removing nozzle 141 corresponds to an inner water removing nozzle of the present invention, and the third water removing nozzle 142 corresponds to a far water removing nozzle of the present invention; the second water removing nozzle 141 and the third water removing nozzle 142 constitute a far water removing nozzle group.

As the first water removing nozzle 140, for example, a flat spay nozzle is used; the first water removing nozzle 140 jets a jet flow of water-removing water at a spread angle θm of, for example, 5 degrees to 30 degrees. Hereinafter, the jet flow of water-removing water jetted from the first water removing nozzle 140 is referred to as a first jet flow 150. The first jet flow 150 collides with the surface of the hot rolling steel sheet 10, and a first water removal single area 151 that is the area of collision of water-removing water is formed on the surface of the hot rolling steel sheet 10. The first water removal single area 151 (a far end water removal single area) is formed such that, in a planar view, its long axis is parallel to the width direction of the hot rolling steel sheet 10.

As the second water removing nozzle 141, for example, a flat spay nozzle is used; the second water removing nozzle 141 jets a jet flow of water-removing water at a spread angle θn of, for example, 10 degrees to 40 degrees. Hereinafter, the jet flow of water-removing water jetted from the second water removing nozzle 141 is referred to as a second jet flow 152. The second jet flow 152 collides with the surface of the hot rolling steel sheet 10, and a second water removal single area 153 (an inner water removal single area) that is the area of collision of water-removing water is formed on the surface of the hot rolling steel sheet 10. The second water removal single area 153 is formed such that its other-end-side end is located closer to the downstream side than its center-side end, that is, formed such that, in a planar view, its long axis is inclined from the width direction of the hot rolling steel sheet 10 by a prescribed angle θp of, for example, 2 degrees. The angle θp is not limited to that of the embodiment, and is set to 0 degrees to 10 degrees.

As the third water removing nozzle 142, for example, a flat spay nozzle is used; the third water removing nozzle 142 jets a jet flow of water-removing water at a spread angle θq of, for example, 5 degrees to 30 degrees, which is smaller than the spread angle θn of the second jet flow 152. Hereinafter, the jet flow of cooling water jetted from the third water removing nozzle 142 is referred to as a third jet flow 154. The third jet flow 154 collides with the surface of the hot rolling steel sheet 10, and a third water removal single area 155 (a far end water removal single area) that is the area of collision of water-removing water is formed on the surface of the hot rolling steel sheet 10. The third water removal single area 155 is formed such that its other-end-side end is located closer to the downstream side than its center-side end, that is, formed such that, in a planar view, its long axis is inclined from the width direction of the hot rolling steel sheet 10 by a prescribed angle θr of, for example, 5 degrees. The angle θr is not limited to that of the embodiment, and is set to 0 degrees to 10 degrees.

The first water removal single area 151 extends from the one end 10*a* to the center side, the second water removal single area 153 extends between the one end 10*a* and the other end 10*b*, and the third water removal single area 155 extends from the other end 10*b* to the center side. The first water removal single area 151 and the second water removal single area 153 overlap in the width direction, and similarly the second water removal single area 153 and the third water removal single area 155 overlap in the width direction. The water removal single areas 151, 153, and 155 cover the entire area in the width direction of the hot rolling steel sheet 10.

In the embodiment, the second condition, the fifth condition, and the sixth condition described above are satisfied.

(2) Second condition: each of the ratio of the distance in the width direction of the overlapping area of the first water removal single area 151 and the second water removal single area 153 to the width of the hot rolling steel sheet 10 (hereinafter, referred to as an overlapping width B1; see FIG. 14) and the ratio of the distance in the width direction of the overlapping area of the second water removal single area 153 and the third water removal single area 155 to the width of the hot rolling steel sheet 10 (hereinafter, referred to as an overlapping width B2; see FIG. 14) be more than 0.0 and less than 0.2. The overlapping width B1 and the overlapping width B2 may be different.

(5) Fifth condition: each of the ratio of the distance in the conveyance direction between the first water removing nozzle 140 and the second water removing nozzle 141 (hereinafter, referred to as an inter-nozzle distance E1; see FIG. 15) to the roll pitch and the ratio of the distance in the conveyance direction between the second water removing nozzle 141 and the third water removing nozzle 142 (hereinafter, referred to as an inter-nozzle distance E2; see FIG. 15) to the roll pitch be larger than 0.25.

(6) Sixth condition: each of the inter-nozzle distances E1 and E2 be less than 0.95. The sixth condition is a condition for minimizing the space 60 shown in FIG. 5 to uniformly cool the hot rolling steel sheet 10 in the width direction, as described above. Thus, although in the drawings of the following embodiments it may appear that the space 60 is formed for convenience of illustration, in practice the space 60 is minimized.

In such a case, as shown in FIG. 15, the cooling water 50 on the hot rolling steel sheet 10 is blocked by the first water removal single area 151, is pushed out to the one end 10*a* side of the hot rolling steel sheet 10, and is discharged to the lateral side of the one end 10*a*.

Subsequently, the discharging water 52 that has flowed from between the first water removal single area 151 and the other end 10*b* is blocked by the second water removal single area 153, and is pushed out to the other end 10*b* side of the hot rolling steel sheet 10. Part of the pushed out cooling water 50 is discharged to the lateral side of the other end 10*b*; on the other hand, the rest of the discharging water 53 flows to the third water removal single area 155 side. At this time, since the second water removal single area 153 is formed at an angle as described above, the cooling water 50 is smoothly discharged from the other end 10*b*.

The discharging water 53 that has flowed from the second water removal single area 153 is blocked by the third water removal single area 155, is pushed out to the other end 10*b* side, and is discharged from the other end 10*b* to the lateral side. At this time, since the third water removal single area 155 is formed at an angle as described above, the cooling water 50 is smoothly discharged from the other end 10*b*. Thus, the removal of the cooling water 50 is performed.

In the removal of the cooling water 50, the sum total of the momenta of the water removing nozzles 140 to 142 is a momentum exceeding a momentum that is enough to change the direction of the flow at a prescribed flow rate of the cooling water that flows on the hot rolling steel sheet from the upstream side in the conveyance direction, to the directions toward the ends of the steel sheet. Therefore, the removal of the cooling water 50 is performed more appropriately by the water removing apparatus 16.

Also in the embodiment, similar effects to the embodiment described above can be exhibited; that is, even when the cooling water 50 has a large water flow density, the removal of the cooling water 50 can be performed appropriately.

Figure 16:
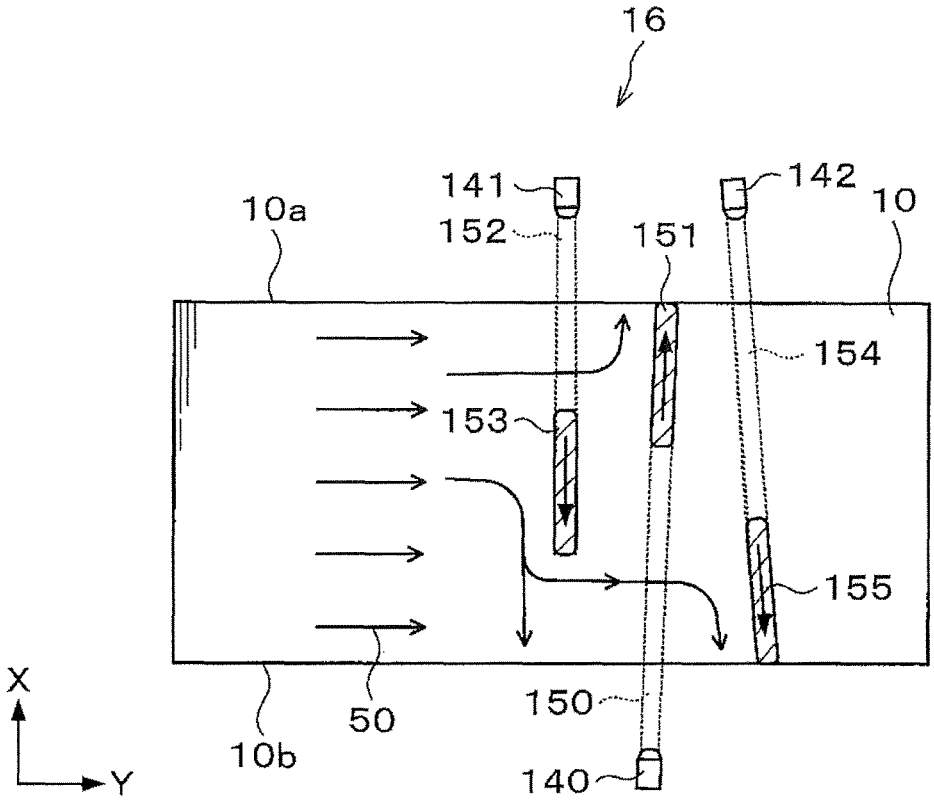
FIG. 16 is a plain view showing an overview of the configuration of a water removing apparatus in another embodiment.
Figure 17:
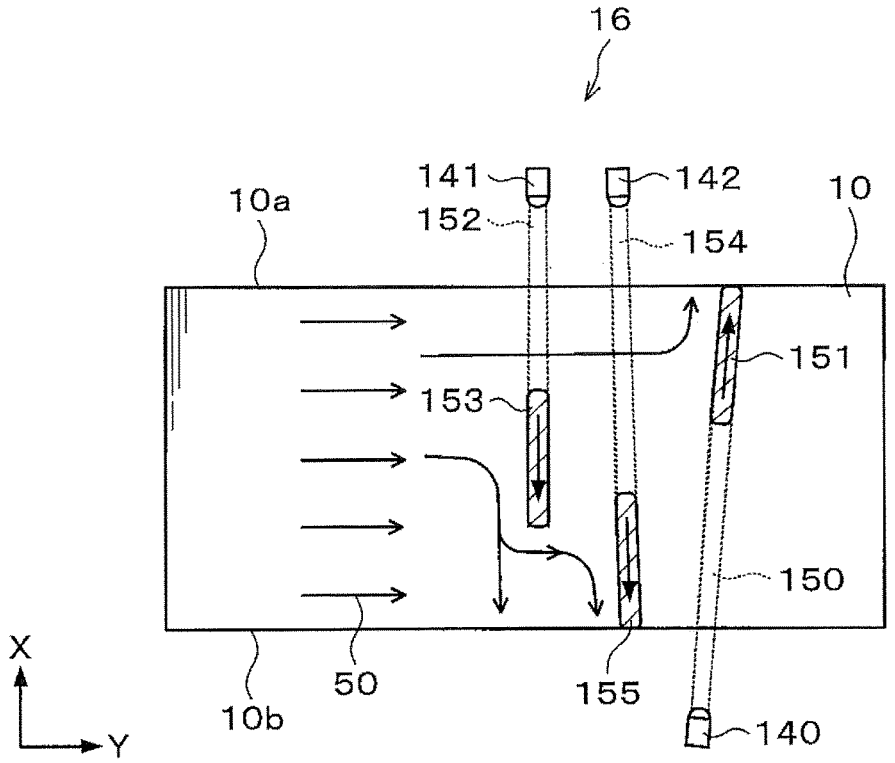
FIG. 17 is a plain view showing an overview of the configuration of a water removing apparatus in another embodiment.

In the above embodiment, as shown in FIG. 16, the first water removing nozzle 140 may be placed between the second water removing nozzle 141 and the third water removing nozzle 142 in the conveyance direction of the hot rolling steel sheet 10. Further, as shown in FIG. 17, the first water removing nozzle 140 may be placed on the downstream side of the third water removing nozzle 142. In any case, the removal of the cooling water 50 can be performed appropriately.

However, in order to perform the removal of the cooling water 50 appropriately, it is necessary that the first water removal single area 151 from the other end 10*b* side cover the upper surface of the one end 10*a* of the hot rolling steel sheet 10, and the third water removal single area 155 from the one end 10*a* side cover the upper surface of the other end 10*b* of the hot rolling steel sheet 10, as described above. Further, it is necessary that the second water removal single area 153 and the third water removal single area 155 from the one end 10*a* side be formed to be aligned in this order in the conveyance direction of the hot rolling steel sheet 10 and be aligned adjacent to each other in this order from the one end 10*a* side to the other end 10*b* side.

Figure 18:
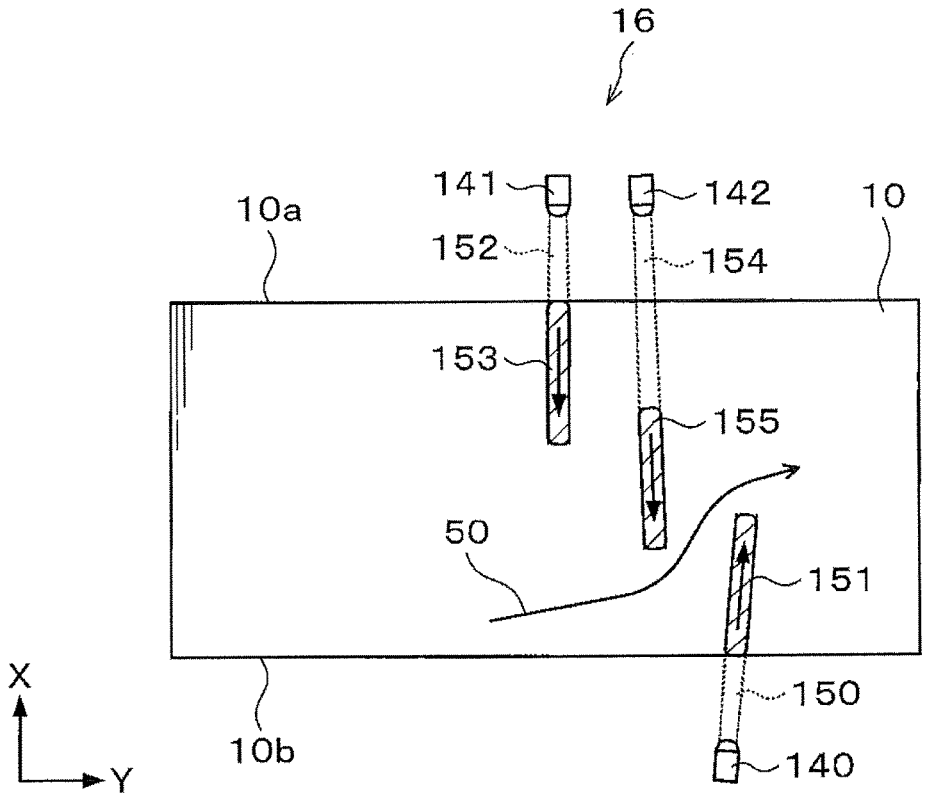
FIG. 18 is an illustration diagram showing an example in which the removal of cooling water is not performed appropriately.
Figure 19:
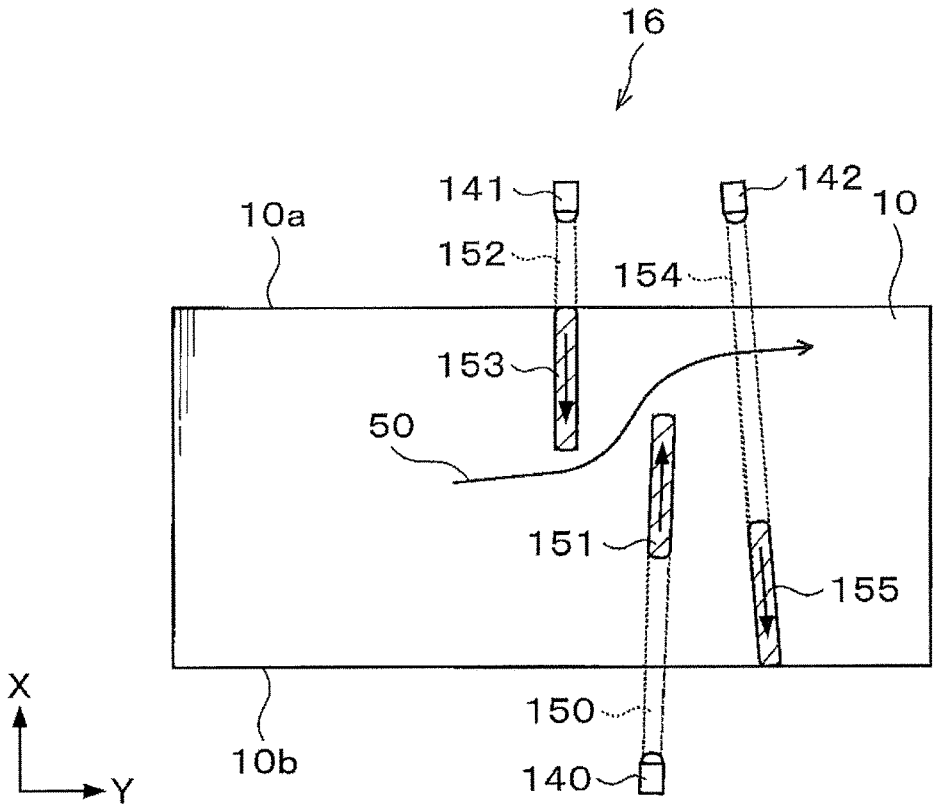
FIG. 19 is an illustration diagram showing an example in which the removal of cooling water is not performed appropriately.

FIG. 18 and FIG. 19 show cases where not all the conditions mentioned above are satisfied and the removal of the cooling water 50 cannot be performed appropriately, for example.

FIG. 18 shows, for example, a case where the first water removal single area 151 from the other end 10*b* side does not cover the upper surface of the one end 10*a* of the hot rolling steel sheet 10, and the third water removal single area 155 from the one end 10*a* side does not cover the upper surface of the other end 10*b* of the hot rolling steel sheet 10. In such a case, the cooling water that has flowed from between the third water removal single area 155 and the other end 10*b* may pass through between the first water removal single area 151 and the one end 10*a* and flow to the downstream side. Consequently, the removal of the cooling water 50 cannot be performed appropriately.

FIG. 19 shows, for example, a case where the first water removal single area 151 from the other end 10*b* side does not cover the upper surface of the one end 10*a* of the hot rolling steel sheet 10, and the second water removal single area 153 and the third water removal single area 155 are not aligned adjacent to each other in this order from the one end 10*a* side to the other end 10*b* side. In such a case, the cooling water that has flowed from between the first water removal single area 151 and the one end 10*a* may pass through between the third water removal single area 155 and the one end 10*a* and flow to the downstream side. Consequently, the removal of the cooling water 50 cannot be performed appropriately.

In the above embodiments, one water removing nozzle 120 or 121 (single far water removing nozzle) shown in FIG. 13 is provided on each side of the hot rolling steel sheet 10, and one first water removing nozzle 140 (a single far water removing nozzle) or one far water removing nozzle group (the water removing nozzles 141 and 142) shown in FIG. 15 is provided on each side of the hot rolling steel sheet 10; however, two or more water removing nozzle 120 or 121, or two or more first water removing nozzle 140 and two or more far water removing nozzle group may be provided. Further, a single far water removing nozzle and a far water removing nozzle group illustrated may be combined and placed on both sides of the hot rolling steel sheet 10.

4-4. Another Embodiment

Although in the above embodiments the water removing apparatus 16 removes the cooling water at the time of cooling the hot rolling steel sheet 10 after finish rolling, the installation position of the water removing apparatus 16 is not limited thereto. The hot rolling for which the water removing apparatus 16 of the present invention is used comprises both thick sheet reverse rolling and thin sheet continuous hot rolling. In each hot rolling, the water removing apparatus 16 may be placed either on the upstream side and the downstream side of the rough rolling mill or on the upstream side and the downstream side of the finish rolling mill, and may perform water removal at the time of cooling the hot rolling steel sheet before and after rough rolling or before and after finish rolling.

Hereinabove, preferred embodiments of the present invention are described with reference to the appended drawings; but the present invention is not limited to these examples. It is clear that one skilled in the art may arrive at various alteration examples or modification examples within the idea described in the claims; such examples should naturally fall within the technical scope of the present invention.

Example 1

Hereinbelow, effects of the first condition to the fifth condition in the case where two water removing nozzles are placed on the lateral side of one end of a hot rolling steel sheet are described. In the verification of the effects, the water removing apparatus 16 shown in FIG. 3 was used as the water removing apparatus. Table 1 shows the results of the verification.

The common conditions in the verification are as follows. Each of the pressures of cooling water jetted from the water removing nozzles 30 and 31 is 20 MPa. The amount of cooling water from the near water removing nozzle 30 is 160 L/min, and the amount of cooling water from the far water removing nozzle 31 is 260 L/min. The width of the hot rolling steel sheet 10 is 2000 mm, that is, each of the reference distances of the near area width A of the first condition and the overlapping width B of the second condition is 2000 mm. The roll pitch is 430 mm, that is, the reference distance of the inter-nozzle distance E of the fifth condition is 430 mm.

In the verification, in a planar view, the distance between the near water removing nozzle 30 and the near end 10*a* of the hot rolling steel sheet 10 is 150 mm, and similarly the distance between the far water removing nozzle 31 and the near end 10*a* is 150 mm. The present inventors have ascertained that, when the distances between the water removing nozzles 30 and 31 and the near end 10*a* are in the range of 110 mm to 300 mm, the height positions of the water removing nozzles 30 and 31 hardly shift, and the water removal effect hardly varies, either.

In the verification, Comparative Examples 1 to 10 are examples in which not all the first condition to the fifth condition are satisfied, and their water removability is assessed as "poor" in Table 1. However, the verification is a verification of showing that the removal of cooling water can be carried out more reliably in the case where the first condition to the fifth condition are satisfied (Examples 1 to 9), and Comparative Examples 1 to 10 are mere comparison target for Examples 1 to 9. Hence, although cases in Comparative Examples 1 to 10 where the removal of cooling water cannot be carried out are shown in the following description for ease of understanding, even such Comparative Examples 1 to 10 provide water removal efficiencies that are improved at least compared with conventional ones, and the Comparative Examples do not necessarily show that they fail to carry out the removal of cooling water.

First, the first condition is verified. In Examples 1 to 3 and Comparative Examples 1 to 2 of the verification, the second condition to the fifth condition are satisfied.

Figure 20:
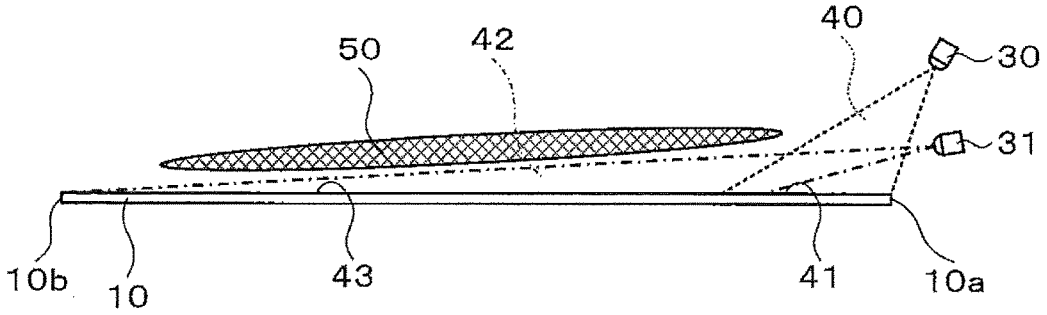
FIG. 20 is an illustration diagram showing an example in which the removal of cooling water is not performed appropriately.

In Comparative Example 1, the near area width A is 0.2. In such a case, since as shown in FIG. 20 the near area 41 is narrow, the far jet flow 42 by itself cannot push out the cooling water 50 to the far end 10*b* side, and the cooling water 50 goes over the far jet flow 42 from the upper side of the far jet flow 42 and leaks to the downstream side of the far area 43. Therefore, the removal of the cooling water 50 cannot be performed appropriately.

Figure 21:
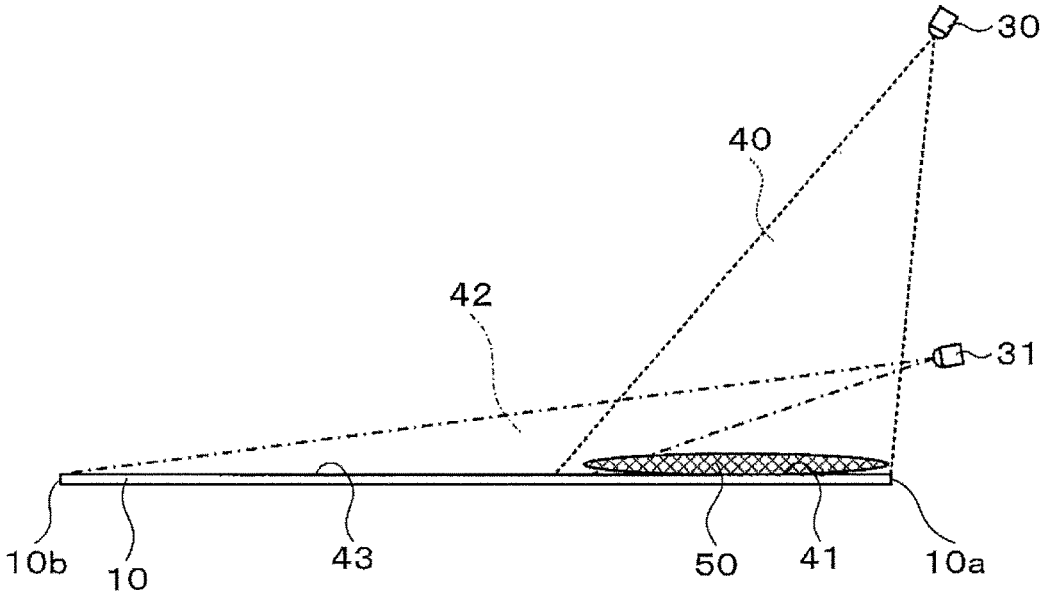
FIG. 21 is an illustration diagram showing an example in which the removal of cooling water is not performed appropriately.

In Comparative Example 2, the near area width A is 0.6. In such a case, since as shown in FIG. 21 the near area 41 is wide, the force with which the near jet flow 40 pushes out the cooling water 50 is weak, and the cooling water 50 leaks near the center of the near area 41. Therefore, the removal of the cooling water 50 cannot be performed appropriately.

In contrast to these Comparative Examples 1 to 2, in Examples 1 to 3, the near area width A is more than 0.2 and less than 0.6, and the first condition is satisfied. It has been verified that in such cases the removal of the cooling water 50 is performed appropriately.

Next, the second condition is verified. In Examples 4 to 5 and Comparative Examples 3 to 4 of the verification, the first condition and the third condition to the fifth condition are satisfied.

Figure 22:
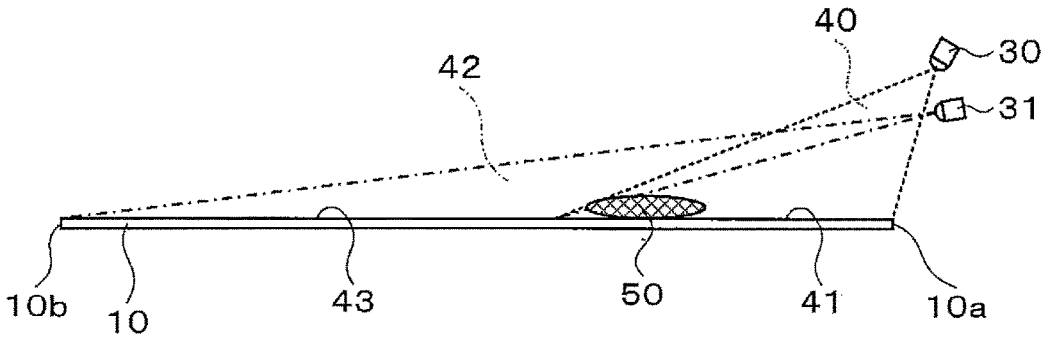
FIG. 22 is an illustration diagram showing an example in which the removal of cooling water is not performed appropriately.

In Comparative Example 3, the overlapping width B is 0.0. In such a case, since as shown in FIG. 22 the near area 41 and the far area 43 do not overlap, the cooling water 50 leaks from between the near area 41 and the far area 43. Therefore, the removal of the cooling water 50 cannot be performed appropriately.

Figure 23:
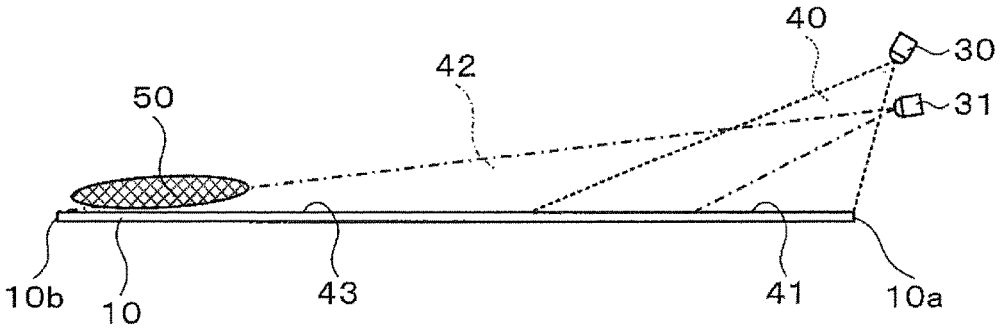
FIG. 23 is an illustration diagram showing an example in which the removal of cooling water is not performed appropriately.

In Comparative Example 4, the overlapping width B is 0.2. In such a case, since as shown in FIG. 23 the overlapping area of the near area 41 and the far area 43 is wide, the spread angle of the far jet flow 42 is large, and the force with which the far jet flow 42 pushes out the cooling water 50 is weak; consequently, the cooling water 50 leaks on the far end 10*b* side of the far area 43. If the spread angle of the far jet flow 42 is reduced, the cooling water 50 goes over the far jet flow 42 and leaks at the far end 10*b* of the far area 43. Therefore, the removal of the cooling water 50 cannot be performed appropriately.

In contrast to these Comparative Examples 3 to 4, in Examples 4 to 5, the overlapping width B is more than 0.0 and less than 0.2, and the second condition is satisfied. It has been verified that in such cases the removal of the cooling water 50 is performed appropriately.

Next, the third condition is verified. In Examples 6 to 7 and Comparative Examples 5 to 6 of the verification, the first condition, the second condition, the fourth condition, and the fifth condition are satisfied.

Figure 24:
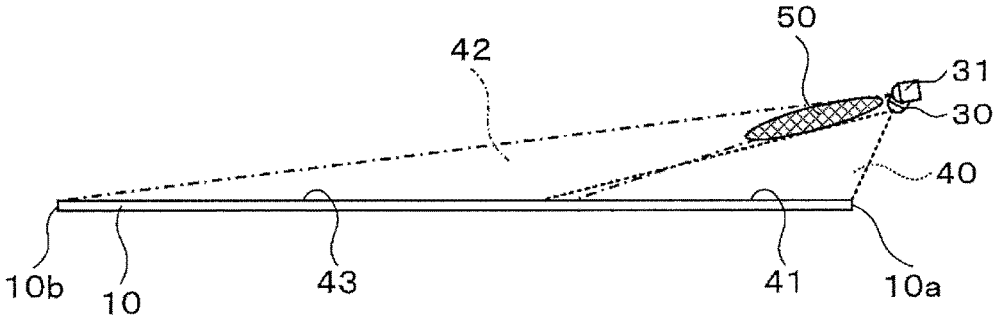
FIG. 24 is an illustration diagram showing an example in which the removal of cooling water is not performed appropriately.

In Comparative Example 5, the near jet flow angle C is 15 degrees. In such a case, since as shown in FIG. 24 the area in the vertical direction of the near jet flow 40 is narrow, the cooling water 50 goes over the near jet flow 40 and flows to the downstream side; further, since the upper end of the near jet flow 40 is located below the lower end of the far jet flow 42, the cooling water 50 mentioned above passes through the lower side of the far jet flow 42, and flows and leaks to the downstream side. Therefore, the removal of the cooling water 50 cannot be performed appropriately.

In Comparative Example 6, the near jet flow angle C is 50 degrees. In such a case, since as shown in FIG. 21 the near water removing nozzle 30 is placed in a high position, the force with which the near jet flow 40 pushes out the cooling water 50 is weak, and the cooling water 50 leaks from the near area 41. Therefore, the removal of the cooling water 50 cannot be performed appropriately.

In contrast to these Comparative Examples 5 to 6, in Examples 6 to 7, the near jet flow angle C is more than 15 degrees and less than 50 degrees, and the third condition is satisfied. It has been verified that in such cases the removal of the cooling water 50 is performed appropriately.

Next, the fourth condition is verified. In Examples 8 to 9 and Comparative Examples 7 to 8 of the verification, the first condition to the third condition and the fifth condition are satisfied.

In Comparative Example 7, the far jet flow angle D is 10 degrees. In such a case, since as shown in FIG. 20 the area in the vertical direction of the far jet flow 42 is narrow, the cooling water 50 goes over the far jet flow 42, and flows and leaks to the downstream side. Therefore, the removal of the cooling water 50 cannot be performed appropriately.

In Comparative Example 8, the far jet flow angle D is 30 degrees. In such a case, since as shown in FIG. 23 the far water removing nozzle 31 is placed in a high position, the force with which the far jet flow 42 pushes out the cooling water 50 is weak, and the cooling water 50 leaks on the far end 10*b* side of the far area 43. Furthermore, since the spread angle of the far jet flow 42 is large, the cooling water 50 leaks on the far end 10*b* side of the far area 43. Therefore, the removal of the cooling water 50 cannot be performed appropriately.

In contrast to these Comparative Examples 7 to 8, in Examples 8 to 9, the far jet flow angle D is more than 10 degrees and less than 30 degrees, and the fourth condition is satisfied. It has been verified that in such cases the removal of the cooling water 50 is performed appropriately.

Next, the fifth condition is verified. In Comparative Examples 9 to 10 of the verification, the first condition to the fourth condition are satisfied.

In Comparative Example 9, the inter-nozzle distance E is 0.25. In such a case, since the near area 41 and the far area 43 are too close, the cooling water 50 that has gone over the near area 41 also goes over the far area 43 and leaks. Therefore, the removal of the cooling water 50 cannot be performed appropriately.

In Comparative Example 10, the inter-nozzle distance E is 0.95. In such a case, the fifth condition is satisfied, and the removal of the cooling water 50 is performed appropriately. However, Comparative Example 10 does not satisfy the sixth condition, and as described above there is a problem that the cooling of the hot rolling steel sheet 10 is made non-uniform in the width direction.

From the above, it has been found that cooling water can be removed more appropriately when the first condition to the fifth condition are satisfied. That is, it has been found that the thresholds of the first condition to the fifth condition are appropriate.

removing nozzles 100 to 102 is 20 MPa. The amount of cooling water from the near water removing nozzle 100 is 140 L/min, the amount of cooling water from the inner water removing nozzle 101 is 160 L/min, and the amount of cooling water from the far water removing nozzle 102 is 120 L/min. The width of the hot rolling steel sheet 10 is 2000 mm, that is, the reference distance of the overlapping widths B1 and B2 of the second condition is 2000 mm. The roll pitch is 430 mm, that is, the reference distance of the inter-nozzle distances E1 and E2 of the fifth condition is 430 mm.

In the verification, in a planar view, the distance between the near water removing nozzle 100 and the near end 10*a* of the hot rolling steel sheet 10, the distance between the inner water removing nozzle 101 and the near end 10*a*, and the distance between the far water removing nozzle 31 and the near end 10*a* are each 150 mm. The present inventors have ascertained that, when the distances between the water removing nozzles 100 to 102 and the near end 10*a* are in the range of 110 mm to 300 mm, the height positions of the water removing nozzles 100 to 102 hardly vary, and the water removal effect hardly varies, either.

In the verification, in addition to the verification of the overlapping widths B1 and B2 of the second condition, the installation positions of the water removing nozzles 100 to 102 on the assumption that the installation position of the water removing nozzle on the most upstream side in the conveyance direction of the hot rolling steel sheet 10 is 0 (zero) are verified. By verifying the installation positions of the water removing nozzles 100 to 102, the fifth condition (the inter-nozzle distances E1 and E2) is verified as well.

In Example 10, as shown in FIG. 7, the near water removing nozzle 100, the inner water removing nozzle 101,

TABLE 1

| | First condition 0.2 < A < 0.6 Near area width A | Second condition 0.0 < B < 0.2 Overlapping width B | Third condition 15 < C < 50 Near jet flow angle C | Fourth condition 10 < D < 30 Far jet flow angle D | Fifth condition 0.25 < E Inter-nozzle distance E | Water removability |
|---|---|---|---|---|---|---|
| Example 1 | 0.3 | 0.05 | 35 | 20 | 0.7 | Good |
| Example 2 | 0.4 | 0.05 | 35 | 20 | 0.7 | Good |
| Example 3 | 0.5 | 0.05 | 35 | 20 | 0.7 | Good |
| Comparative Example 1 | 0.2 | 0.05 | 35 | 20 | 0.7 | Poor |
| Comparative Example 2 | 0.6 | 0.05 | 35 | 20 | 0.7 | Poor |
| Example 4 | 0.4 | 0.05 | 35 | 20 | 0.7 | Good |
| Example 5 | 0.4 | 0.15 | 35 | 20 | 0.7 | Good |
| Comparative Example 3 | 0.4 | 0 | 35 | 20 | 0.7 | Poor |
| Comparative Example 4 | 0.4 | 0.2 | 35 | 20 | 0.7 | Poor |
| Example 6 | 0.4 | 0.05 | 20 | 20 | 0.7 | Good |
| Example 7 | 0.4 | 0.05 | 40 | 20 | 0.7 | Good |
| Comparative Example 5 | 0.4 | 0.05 | 15 | 20 | 0.7 | Poor |
| Comparative Example 6 | 0.4 | 0.05 | 50 | 20 | 0.7 | Poor |
| Example 8 | 0.4 | 0.05 | 35 | 15 | 0.7 | Good |
| Example 9 | 0.4 | 0.05 | 35 | 25 | 0.7 | Good |
| Comparative Example 7 | 0.4 | 0.05 | 35 | 10 | 0.7 | Poor |
| Comparative Example 8 | 0.4 | 0.05 | 35 | 30 | 0.7 | Poor |
| Comparative Example 9 | 0.4 | 0.05 | 35 | 20 | 0.25 | Poor |
| Comparative Example 10 | 0.4 | 0.05 | 35 | 20 | 0.95 | Good |

Example 2

Next, effects of the present invention in the case where three water removing nozzles are placed on the lateral side of one end of a hot rolling steel sheet are described. In the verification of the effects, the water removing apparatus 16 shown in FIG. 6 was used as the water removing apparatus. Table 2 shows the results of the verification.

The common conditions in the verification are as follows. Each of the pressures of cooling water jetted from the water and the far water removing nozzle 102 are aligned in this order in the conveyance direction of the hot rolling steel sheet 10. Here, each of the overlapping widths B1 and B2 is 0.1, and the second condition is satisfied. Further, each of the inter-nozzle distances E1 and E2 is 0.3, and the fifth condition is satisfied. It has been verified that in such a case the removal of the cooling water 50 is performed appropriately.

In contrast, the overlapping width B1 is 0 (zero) in Comparative Example 11, and the overlapping width B2 is 0 (zero) in Comparative Example 12. That is, Comparative Examples 11 and 12 do not satisfy the second condition; it has been found that in such cases the removal of the cooling water 50 is not performed appropriately.

In Comparative Example 13, as shown in FIG. 8, the near area 111, the far area 115, and the inner area 113 are formed to be aligned in this order in the conveyance direction. In Comparative Example 14, as shown in FIG. 9, the inner area 113, the near area 111, and the far area 115 are formed to be aligned in this order in the conveyance direction. In Comparative Example 15, as shown in FIG. 10, the inner area 113, the far area 115, and the near area 111 are formed to be aligned in this order in the conveyance direction. It has been found that, in the case where the near area 111, the inner area 113, and the far area 115 are not aligned in this order in the conveyance direction of the hot rolling steel sheet 10 like in these Comparative Examples 13 to 15, the cooling water 50 flows to the downstream side, and the removal of the cooling water 50 cannot be performed appropriately, as described above.

From the above, it has been found that cooling water can be removed appropriately in the case where three water removing nozzles are arranged on the lateral side of one end of a hot rolling steel sheet in the manner of the present invention.

21 cooling water nozzle
30 near water removing nozzle
31 far water removing nozzle
40 near jet flow
41 near area
41*a* center-side end
42 far jet flow
43 far area
43*a* center-side end
43*b* far-end-side end
50 cooling water
51 discharging water
52 discharging water
53 discharging water
60 space
100 near water removing nozzle
101 inner water removing nozzle
102 far water removing nozzle
110 near jet flow
111 near area
112 inner jet flow
113 inner area
114 far jet flow
115 far area

TABLE 2

| | Second condition 0.0 < B < 0.2 | | Installation position on assumption that installation position of water removing nozzle on most upstream side is 0 (zero) (including fifth condition: 0.25 < E) | | | |
|---|---|---|---|---|---|---|
| | Overlapping width (near-intermediate) B1 | Overlapping width (intermediate-far) B2 | Installation position of near nozzle | Installation position of inner nozzle | Installation position of far nozzle | Water removability |
| Example 10 | 0.1 | 0.1 | 0 | 0.3 | 0.6 | Good |
| Comparative Example 11 | 0 | 0.1 | 0 | 0.3 | 0.6 | Poor |
| Comparative Example 12 | 0.1 | 0 | 0 | 0.3 | 0.6 | Poor |
| Comparative Example 13 | 0.1 | 0.1 | 0 | 0.6 | 0.3 | Poor |
| Comparative Example 14 | 0.1 | 0.1 | 0.3 | 0 | 0.6 | Poor |
| Comparative Example 15 | 0.1 | 0.1 | 0.6 | 0 | 0.3 | Poor |

INDUSTRIAL APPLICABILITY

The present invention is useful in, when cooling a hot rolling steel sheet after finish rolling of a hot rolling process, and removing cooling water jetted to the hot rolling steel sheet, and is particularly useful in removing a large amount of cooling water.

REFERENCE SIGNS LIST

1 hot rolling facility
5 slab
10 hot rolling steel sheet
10*a* one end (near end)
10*b* other end (far end)
11 heating furnace
12 width-direction rolling mill
13 rough rolling mill
14 finish rolling mill
15 cooling apparatus
15*a* upper cooling apparatus
15*b* lower cooling apparatus
16 water removing apparatus
17 winding apparatus
18 conveyor roll
20 cooling water nozzle
120 first water removing nozzle
121 second water removing nozzle
130 first jet flow
131 first water removal single area
132 second jet flow
133 second water removal single area
140 first water removing nozzle
141 second water removing nozzle
142 third water removing nozzle
150 first jet flow
151 first water removal single area
152 second jet flow
153 second water removal single area
154 third jet flow
155 third water removal single area

The invention claimed is:

1. A water removing apparatus for steel sheet cooling water in a hot rolling process that removes cooling water jetted to a hot rolling steel sheet when cooling the hot rolling steel sheet before and after rough rolling or before and after finish rolling of the hot rolling process, the water removing apparatus comprising:

a plurality of water removing nozzles that are aligned in a conveyance direction of the hot rolling steel sheet on one end or both in a width direction of a steel sheet conveyance plane and jet water-removing water to the steel sheet conveyance plane, and a plurality of water removal areas, wherein each water removal area is an area of collision of water-removing water jetted from one of the water removing nozzles in the steel sheet conveyance plane, and has a prescribed width less than a width of the steel sheet conveyance plane, and the plurality of water removing nozzles are arranged so as to cover the entire area in the width direction of the steel sheet conveyance plane with the plurality of water removal areas, wherein a ratio of the distance in the conveyance direction between any two adjacent water removing nozzles to the distance in the conveyance direction between the centers of a pair of conveyor rolls adjacent in the conveyance direction is larger than 0.25 and less than 0.95, one or more water removing nozzles among said plurality of water removing nozzles comprise a single far water removing nozzle, a far water removing nozzle group, or a combination thereof, the single far water removing nozzle forms a far end water removal single area that does not include the one end but includes another end in the width direction of the steel sheet conveyance plane, the far water removing nozzle group comprises one or more inner water removing nozzles and the far water removing nozzle, and one or more inner water removal single areas, which the one or more inner water removing nozzles form and which do not include either end in the width direction of the steel sheet conveyance plane, and the far end water removal single area, which the far water removing nozzle forms, the one or more inner water removal single areas and the far end water removal single area being aligned in order from the one end to the other end while overlapping with each other in the width direction of the steel sheet conveyance plane and aligned in order from an upstream side to a downstream side without overlapping in the conveyance direction, a near water removing nozzle is placed on the lateral side of the one end in the width direction of the steel sheet conveyance plane, the near water removing nozzle forms a near end water removal single area, which is not included in either the far end water removal single area that the single far water removing nozzle forms or a far water removal area group that the far water removing nozzle group forms and which includes the one end in the width direction of the steel sheet conveyance plane on the upstream side in the conveyance direction of the far end water removal single area or the far water removal area group, a ratio of the distance in the width direction of the overlapping area of the near end water removal single area and the far end water removal single area to the width of the steel sheet conveyance plane is more than 0.0 and less than 0.2, or ratios of the distance in the width direction of the overlapping area of the near end water removal single area and the inner water removal single areas, and the distance in the width direction of the overlapping area of the near end water removal single area and the far end water removal single area to the width of the steel sheet conveyance plane are respectively more than 0.0 and less than 0.2.

2. The water removing apparatus for steel sheet cooling water in a hot rolling process according to claim 1, wherein one or more of the single far water removing nozzle(s) or one or more of the far water removing nozzle group(s) are placed on both sides in the width direction of the steel sheet conveyance plane.

3. The water removing apparatus for steel sheet cooling water in a hot rolling process according to claim 1, wherein water removal is continuously performed by at least the single far water removing nozzle or the far water removing nozzle group and the near water removing nozzle from the one end to the other end in the width direction of the steel sheet conveyance plane.

4. The water removing apparatus for steel sheet cooling water in a hot rolling process according to claim 1, wherein a water removing nozzle, which is placed in the downstream side at a second or a subsequent position from the upstream side in the conveyance direction among the plurality of water removing nozzles, forms one of the plurality of water removal areas in a manner that, in a planar view, a far side of a long axis of the water removal single area is inclined from the width direction toward the downstream side in the conveyance direction.

5. A water removing method for steel sheet cooling water in a hot rolling process that removes cooling water jetted to a hot rolling steel sheet when cooling the hot rolling steel sheet before and after rough rolling or before and after finish rolling of the hot rolling process, the water removing method comprising:

removing cooling water by jetting water-removing water to the hot rolling steel sheet with a plurality of water removing nozzles that are aligned in a conveyance direction of the hot rolling steel sheet on one end or both in a width direction of the hot rolling steel sheet, wherein a ratio of the distance in the conveyance direction between any two adjacent water removing nozzles to the distance in the conveyance direction between the centers of a pair of conveyor rolls adjacent in the conveyance direction is larger than 0.25 and less than 0.95, a plurality of water removal areas, wherein each water removal area is an area of collision of water-removing water jetted from one of the water removing nozzles on the hot rolling steel sheet, and has a prescribed width less than a width of the hot rolling steel sheet, and the plurality of water removal areas formed by the plurality of water removing nozzles cover the entire area in the width direction of the hot rolling steel sheet, one or more water removing nozzles among said plurality of water removing nozzles comprise a far water removing nozzle, a far water removing nozzle group, or a combination thereof, the single far water removing nozzle forms a far end water removal single area that does not include the one end but includes another end in the width direction of the hot rolling steel sheet, the far water removing nozzle group comprises one or more inner water removing nozzles and the far water removing nozzle, and one or more inner water removal single areas, which the one or more inner water removing nozzles form and which do not include either end in the width direction of the hot rolling steel sheet, and the far end water removal single area, which the far water removing nozzle forms, the one or more inner water removal single areas and the far end water removal single area being aligned in order from the one end to the other end while overlapping with each other in the width direction of the hot rolling steel sheet and are aligned in order from an upstream side to a downstream side without overlapping in the conveyance direction, a near water removing nozzle is placed on the lateral side of the one end in the width direction of the hot rolling steel sheet, the near water removing nozzle forms a near end water removal single area, which is not included in either the far end water removal single area that the single far water removing nozzle forms or a far water removal area group that the far water removing nozzle group forms and which includes the one end in the width direction of the hot rolling steel sheet on the upstream side in the conveyance direction of the far end water removal single area or the far water removal area group, a ratio of the distance in the width direction of the overlapping area of the near end water removal single area and the far end water removal single area to the width of the hot rolling steel sheet is more than 0.0 and less than 0.2, or ratios of the distance in the width direction of the overlapping area of the near end water removal single area and the inner water removal single areas, and the distance in the width direction of the overlapping area of the near end water removal single area and the far end water removal single area to the width of the hot rolling steel sheet are respectively more than 0.0 and less than 0.2.

6. The water removing method for steel sheet cooling water in a hot rolling process according to claim 5, wherein one or more of the single far water removing nozzle(s) or one or more of the far water removing nozzle group(s) are placed on both sides in the width direction of the hot rolling steel sheet.

7. The water removing method for steel sheet cooling water in a hot rolling process according to claim 5, wherein water removal is continuously performed by at least the single far water removing nozzle or the far water removing nozzle group and the near water removing nozzle from the one end to the other end in the width direction of the hot rolling steel sheet.

8. The water removing method for steel sheet cooling water in a hot rolling process according to claim 5, wherein a water removing nozzle, which is placed in the downstream side at a second or a subsequent position from the upstream side in the conveyance direction among the plurality of water removing nozzles, forms one of the plurality of water removal areas in a manner that, in a planar view, a far side of a long axis of the water removal single area is inclined from the width direction toward the downstream side in the conveyance direction.

* * * * *